US007395000B2

(12) United States Patent
Karasawa

(10) Patent No.: US 7,395,000 B2
(45) Date of Patent: Jul. 1, 2008

(54) IMAGE-FORMING DEVICE WITH CONTROL OF DEVELOPER BIAS

(75) Inventor: Minoru Karasawa, Nishikasugai-gun (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 315 days.

(21) Appl. No.: 11/236,548

(22) Filed: Sep. 28, 2005

(65) Prior Publication Data

US 2006/0067719 A1 Mar. 30, 2006

(30) Foreign Application Priority Data

Sep. 30, 2004 (JP) ..... 2004/288280

(51) Int. Cl.
*G03G 15/00* (2006.01)

(52) U.S. Cl. ..... 399/44; 399/48; 399/49

(58) Field of Classification Search ..... 399/38, 399/44, 48, 49, 53, 55, 60
See application file for complete search history.

(56) References Cited

U.S. PATENT DOCUMENTS 4,416,535 A * 11/1983 Tottori ..... 399/43
5,170,213 A * 12/1992 Yamaguchi et al. ..... 399/281
5,878,312 A * 3/1999 Hisada ..... 399/149
6,064,847 A * 5/2000 Iwamatsu et al. ..... 399/283
6,067,434 A * 5/2000 Takagi et al. ..... 399/286
6,859,628 B2 * 2/2005 Kobashigawa ..... 399/44

FOREIGN PATENT DOCUMENTS

| | | | |
|---|---|---|---|
| JP | 2001125324 | | 5/2001 |
| JP | 2001228699 | | 8/2001 |
| JP | 2001272833 | | 10/2001 |
| JP | 2003043761 | | 2/2003 |
| JP | 2006-126821 | * | 5/2006 |

* cited by examiner

*Primary Examiner*—Hoan H Tran
(74) *Attorney, Agent, or Firm*—Banner & Witcoff, Ltd

(57) ABSTRACT

In an image-forming device, a controller controls the value of an effective developer bias that is established between the electric potential of a latent image formed on an image bearing body and the electric potential of a developer bearing body, to thereby develop the latent image with a non-magnetic, single-component developer agent. The controller sets a target transmission density in a region in which the transmission density of the developer agent is in a proportional relationship with respect to the effective developer bias, and controls the value of the effective developer bias based on the target transmission density and the proportional relationship between the transmission density and the effective developer bias.

15 Claims, 14 Drawing Sheets

77

| | | RELATIVE HUMIDITY (%) | | | | | |
|---|---|---|---|---|---|---|---|
| | / | 0 | 20 | 40 | 60 | 80 | 100 |
| TEMPERATURE (°C) | 10 | | | | | | |
| | 15 | | | | | | |
| | 20 | | | | 352 | | |
| | 25 | | | | | | |
| | 30 | | | | | | |
| | 35 | | | | | | |

FIG.15(b)

81

| | ACCUMULATED DRIVE TIME LENGTH | | | | |
|---|---|---|---|---|---|
| ACCUMULATED TONER CONSUMPTION AMOUNT | | | | | |
| | | | | | |
| | | | | | |
| | | | | | |
| | | | | | |

IMAGE-FORMING DEVICE WITH CONTROL OF DEVELOPER BIAS

BACKGROUND OF THE INVENTION

1. Field of the Invention

The present invention relates to an image-forming device such as a laser printer.

2. Description of Related Art

There have been proposed electro-photographic image forming devices of a type that uses a non-magnetic, single-component developer agent. Generally, a developing cartridge is detachably mounted in the image forming device of this type. The developing cartridge includes: a toner accommodating chamber, a supply roller, a developing roller, and a layer thickness regulation blade.

In the developing cartridge, an agitator is disposed in the toner accommodating chamber. The supply roller is provided facing the developing roller. The supply roller is in contact with the developing roller. The layer thickness regulation blade is pressed against the surface of the developing roller.

The toner in the toner accommodating chamber is supplied to the supply roller by the agitator. As the supply roller rotates, the toner is supplied from the supply roller to the surface of the developing roller. When the toner is between the supply roller and the developing roller, the toner is electrically charged due to friction between the supply roller and the developing roller. As the developing roller rotates, the toner on the surface of the developing roller enters the gap between the layer thickness regulation blade and the developing roller. While the toner is in the gap between the layer thickness regulation blade and the developing roller, the toner is further electrically charged due to friction between the layer thickness regulation blade and the developing roller. The toner is formed or shaped in a layer of a certain amount of thickness and is supported on the surface of the developing roller.

The developing cartridge is mounted in the image forming device, with the developing roller facing a photosensitive drum in the image forming device. An electrostatic latent image is formed on the photosensitive drum. The developing roller is applied with a certain amount of developing bias voltage. Accordingly, when the toner layer on the developing roller faces the photosensitive drum, the toner layer develops the electrostatic latent image into a visible toner image. The toner image is transferred onto the paper. Thus, a visible image corresponding to the electrostatic latent image is finally formed on the paper.

Generally, the image-forming device that uses the non-magnetic, single component developer agent exhibits the relationship between the effective developing bias voltage and the transmission density as shown in FIG. 1.

The "effective developing bias voltage" is a potential difference between the developing roller and the electrostatic latent image formed on the photosensitive drum. In other words, the "effective developing bias voltage" is a difference between the developing bias voltage applied to the developing roller and the electric potential at the portions of the photosensitive drum where the electrostatic latent image is formed.

The "transmission density" is a quantity that is proportional to the amount of toner adhering to the paper per unit area.

As shown in FIG. 1, when the effective developing bias voltage is relatively low, the transmission density changes in proportion to the effective developing bias voltage. However, when the effective developing bias voltage becomes relatively high, the transmission density is saturated and is maintained at a constant value regardless of whether the effective developing bias voltage changes.

Japanese patent Laid-Open No. 2003-43761 has proposed an image-forming device, which exhibits the developing characteristics of FIG. 1 and which stabilizes its development by setting the effective developing bias voltage to have a sufficiently high value that allows the transmission density to be saturated at the constant value.

SUMMARY OF THE INVENTION

It is an objective of the present invention to provide an improved image-forming device that can form images at a more stable image density.

In order to attain the above and other objects, the present invention provides an image-forming device, including: an image bearing body; a developer bearing body; and a controller. The image bearing body forms a latent image thereon. The developer bearing body is disposed facing the image bearing body and is in contact with the image bearing body. The developer bearing body supports thereon a non-magnetic, single-component developer agent. The controller controls the value of an effective developer bias that is established between the electric potential of the latent image and the electric potential of the developer bearing body, to thereby develop the latent image with the non-magnetic, single-component developer agent. The controller sets a target transmission density in a region in which the transmission density of the developer agent is in a proportional relationship with respect to the effective developer bias, and controls the value of the effective developer bias based on the target transmission density and the proportional relationship between the transmission density and the effective developer bias.

BRIEF DESCRIPTION OF THE DRAWINGS

The above and other objects, features and advantages of the invention will become more apparent from reading the following description of the preferred embodiments taken in connection with the accompanying drawings in which:

FIG. 5(*b*) shows a transmission-density conversion table in FIG. 5(*a*);

FIG. 8(*b*) is a remaining part of the flowchart of the density correction processing;

FIG. 15(*b*) shows details of the accumulated drive time/consumption amount table of FIG. 15(*a*).

DETAILED DESCRIPTION OF THE PREFERRED EMBODIMENTS

Figure 1:
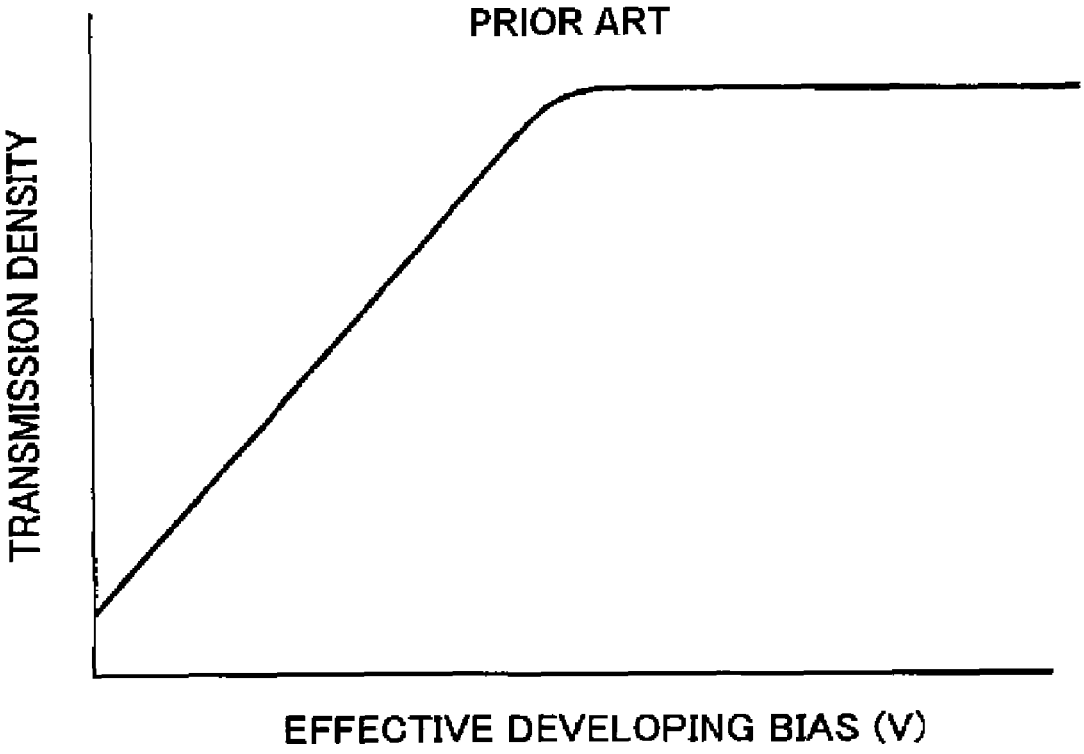
FIG.1 PRIOR ART
FIG. 1 shows the relationship between the effective developing bias voltage and the transmission density in an image forming device of a type that uses a non-magnetic, single component developer agent.
Figure 2:
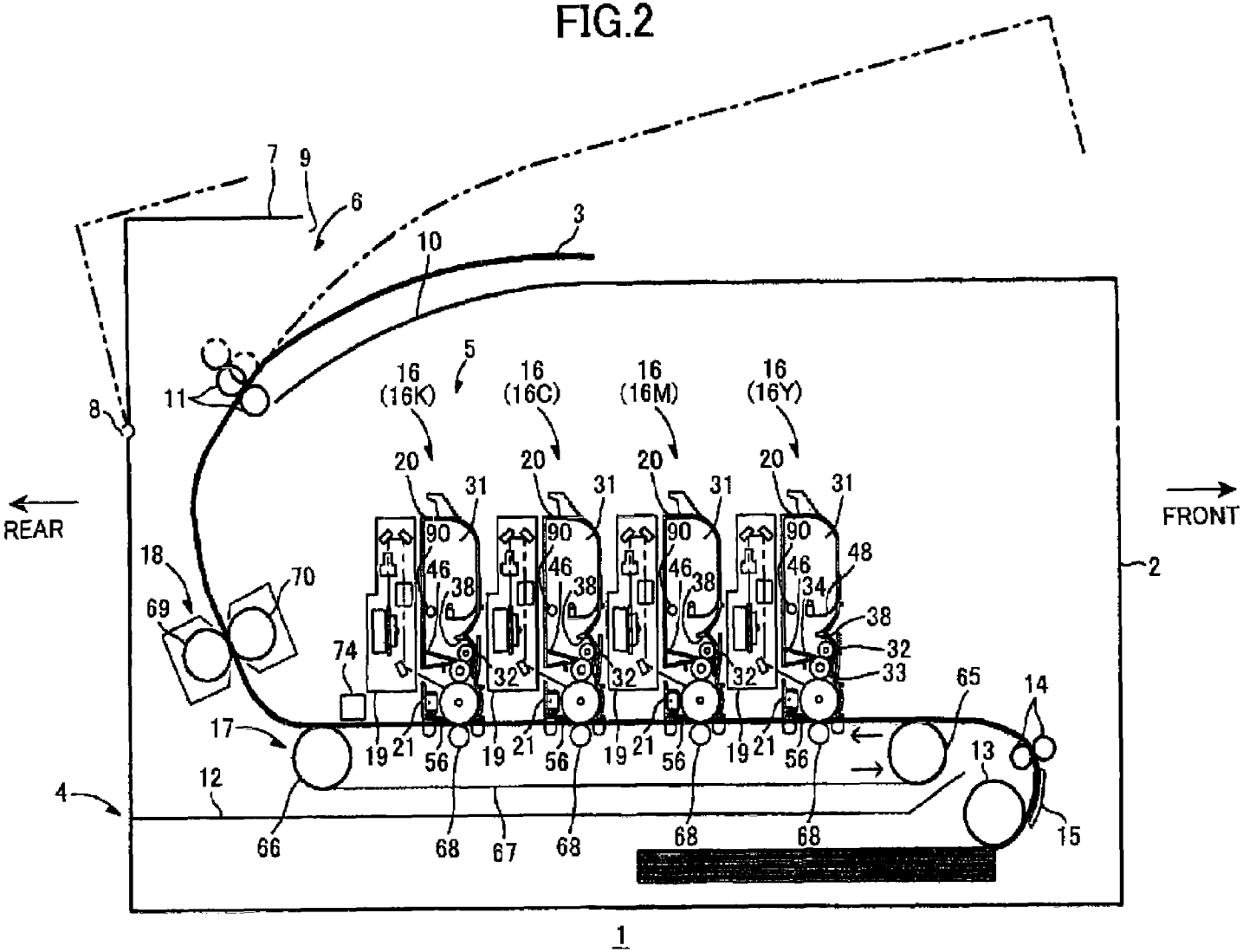
FIG. 2 is a side sectional view showing essential components of a color laser printer according to a first embodiment of the present invention.

An image-forming device according to preferred embodiments of the present invention will be described while referring to the accompanying drawings wherein like parts and components are designated by the same reference numerals to avoid duplicating description.

First Embodiment

A color laser printer 1 according to a first embodiment will be described with reference to FIG. 2 to FIG. 6.

The color laser printer 1 is of a horizontal-tandem type, in which a plurality of process units 16 are arranged in line along a horizontal direction. The laser printer 1 has a main casing 2, in which a paper supplying section 4, an image forming section 5, and a paper discharging section 6 are provided.

The paper supplying section 4 is for supplying a sheet of paper 3 as a recording medium. The image forming section 5 is for forming an image on the sheet of paper 3 supplied from the paper supplying section 4. The paper discharging section 6 is for discharging the sheet of paper 3 formed with images by the image forming section 5.

The main casing 2 acts as a housing of the color laser printer 1. The main casing 2 is of a box shape with its upper opening being covered by a top cover 7. The top cover 7 is supported rotatably via a hinge 8 to the main casing 2, and is able to open and close with respect to the main casing 2 as shown in the broken line.

In the following description, the expressions "front", "rear", "upper", "lower", "right", and "left" are used to define the various parts when the color laser printer 1 is disposed in an orientation in which it is intended to be used. More specifically, "rear side" means the side in which the hinge 8 is located, and "front side" is the side opposite to the rear side with respect to the horizontal (front-to-rear) direction.

The top cover 7 defines a paper discharge opening 9. The top cover 7 includes a discharge tray 10 and a pair of discharge rollers 11. The discharge opening 9 is for discharging papers 3 outside the main casing 2. The discharge tray 10 is of a concave shape with its rear side nearer to the discharge opening 9 being deeper than its front side. Thus, papers 3 can be stacked on the discharge tray 10. The discharge rollers 11 are located in the paper discharge opening 9 at the rear edge of the discharge tray 10. When the top cover 7 opens or closes, the discharge opening 9, the discharge tray 10, and the discharge rollers 11 move in an integrated manner with the top cover 7.

The paper supplying section 4 is located in a lower portion of the main casing 2. The paper supplying section 4 includes: a paper supply tray 12; a paper supply roller 13; a pair of transfer rollers 14; and a guide member 15. The paper supply tray 12 is detachably mounted in the main casing 2. The paper supply tray 12 can be mounted to or detached from the main casing 2 horizontally from the front side of the main casing 2. The paper supply roller 13 is located above the front edge of the paper supply tray 12. The transfer rollers 14 are located in the downstream side of the paper supply roller 13 with respect to the paper conveying direction. The guide member 15 is located between the paper supply roller 13 and the transfer roller 14. The guide member 15 extends between the paper supply roller 13 and the transfer roller 14 substantially vertically in the paper conveying direction.

Papers 3 are stacked in the paper supply tray 12. The paper supply tray 12 includes a pressing plate (not shown), which allows the uppermost paper stacked in the paper supply tray 12 to be in contact with the paper supply roller 13 from below and to be pressed against the paper supply roller 13.

When the paper supply roller 13 rotates, the uppermost paper in the paper supply tray 12 is supplied from the paper supply tray 12 to the transfer rollers 14. The paper 3 supplied from the paper supply tray 12 is guided by the guide member 15 and is conveyed to the transfer rollers 14. Subsequently, as the transfer rollers 14 rotate, the paper 3 is conveyed to the transfer positions, which are located between a conveyor belt 67 and photosensitive drums 56 as will be described later.

The image forming section 5 includes the plurality of process units 16, a transfer section 17, and a fixing section 18. The process units 16 are provided in one-to-one correspondence with a plurality of different colors of toner.

More specifically, the process units 16 include four process units: a yellow process unit 16Y, a magenta process unit 16M, a cyan process unit 16C, and a black process unit 16K. The process units 16Y, 16M, 16C, and 16K are arranged in this order from the front side to the rear side. The process units 16Y, 16M, 16C, and 16K are disposed separate from one another by predetermined distances. The process units 16Y, 16M, 16C, and 16K are disposed at the same vertical position with one another. In other words, the process units 16Y, 16M, 16C, and 16K are disposed in a horizontally-overlapping condition with one another.

Each process unit 16 includes: a scanner unit 19, a developing unit 20, and a photosensitive drum unit 21.

The scanner unit 19 is disposed apart from the conveyor belt 67 in the vertical direction. Each scanner unit 19 is fixedly mounted in the main casing 2. The scanner units 19 are located in the same vertical position with one another. In other words, the scanner units 19 are in a horizontally-overlapping condition with one another.

Figure 3:
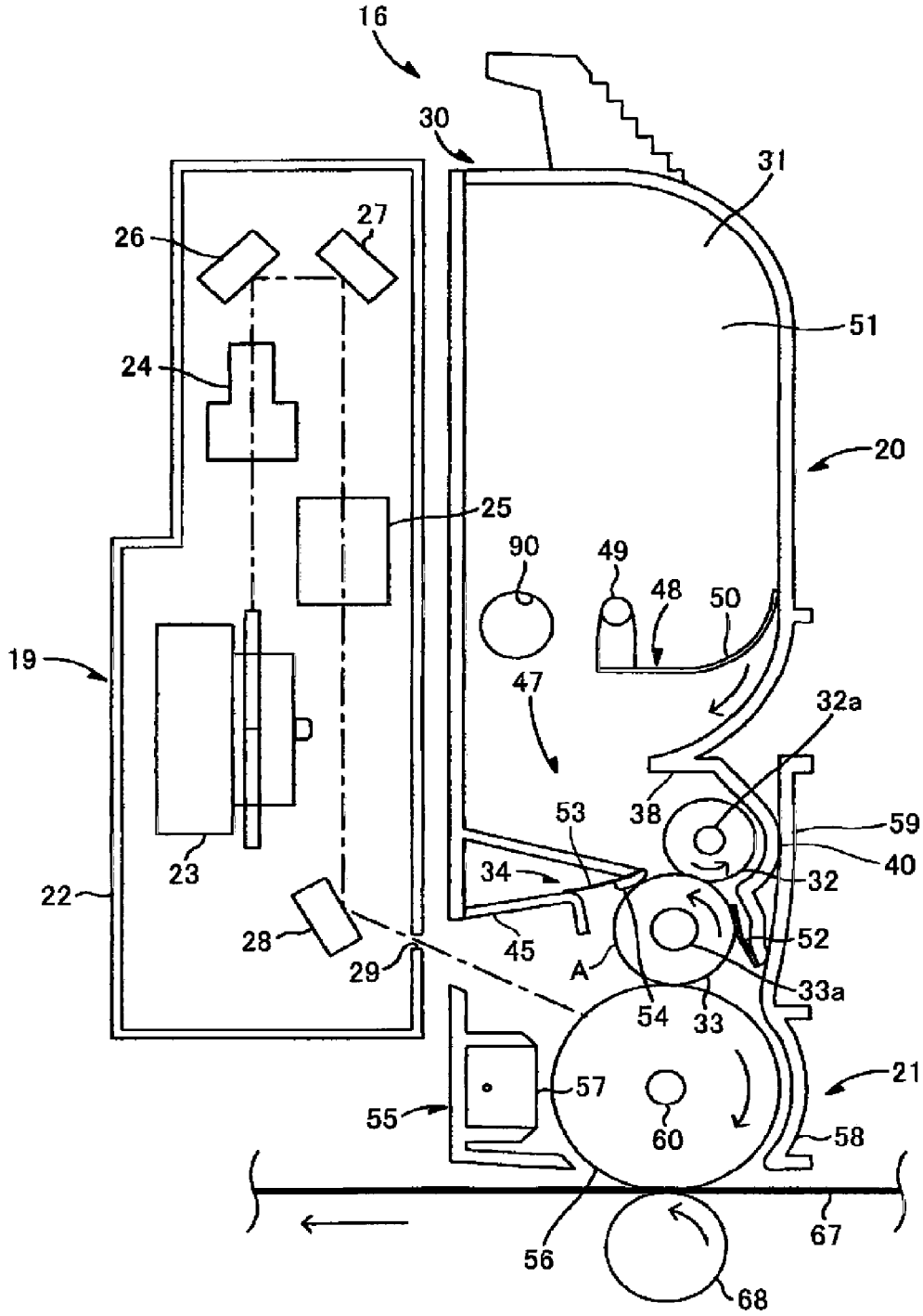
FIG. 3 is an enlarged side sectional view showing essential components of a process unit in FIG. 2.

As shown in the FIG. 3, the scanner unit 19 includes a scanner casing 22. In the scanner casing 22, the scanner unit 19 has: a laser emitting portion (not shown), a polygon mirror 23, lenses 24 and 25, and reflecting mirrors 26, 27, and 28.

The scanner casing 22 is of a box shape, which is substantially in an elongated rectangular shape seen from the side thereof. The scanner casing 22 is fixedly mounted in the main casing 2. The scanner casing 22 is oriented with its longitudinal direction being parallel to the vertical direction. An irradiating window 29 is formed on a wall of the scanner casing 22 that faces the photosensitive drum unit 21. A laser beam exits from the scanner casing 22 through the irradiating window 29.

In the scanner unit 19, a laser beam is emitted from the emitting portion (not shown) based on image data indicative of an image desired to be formed. The laser beam reflects off the polygon mirror 23, passes through the lens 24, reflects off the reflecting mirror 26, reflects off the reflecting mirror 27, passes through the lens 25, and reflects off the reflecting mirror 28, before exiting the scanner casing 22 through the irradiating window 29. As described later, the photosensitive drum 56 is irradiated with the laser beam outputted from the irradiating window 29.

The developing unit 20 includes a developing casing 30. The developing casing 30 is of a box shape having substantially an elongated rectangular shape seen from the side thereof. The developing casing 30 is opened at its bottom. A toner accommodating chamber 31 is defined in the upper part in the interior of the developing casing 30. A developing chamber 47 is defined in the lower part in the interior of the developing casing 30. Accordingly, the developing chamber 47 is located below the toner accommodating chamber 31. The developing unit 20 includes a supply roller 32, a developing roller 33, and a layer thickness regulation blade 34, all of which are mounted inside the developing chamber 47.

Toner is accommodated in the toner accommodating chamber 31. According to this embodiment, toner is a non-magnetic, single-component polymer toner with positively charging nature, and serves as a developer agent. More specifically, yellow toner is accommodated in the toner accommodating chamber 31 in the yellow process unit 16Y, magenta toner is accommodated in the toner accommodating chamber 31 in the magenta process unit 16M, cyan toner is accommodated in the toner accommodating chamber 31 in the cyan process unit 16C, and black toner is accommodated in the toner accommodating chamber 31 in the black process unit 16K.

More specifically, toner is a polymer toner with substantially spherical particles with substantially uniform diameters. The polymer toner includes binding resins as its main component. Each binding resin is made by copolymerizing a polymerizing monomer using a well-known polymerization method such as suspension polymerization. Examples of the polymerizing monomer include styrene monomers, such as styrene, and acrylic monomers, such as acrylic acid, alkyl (C1-C4) acrylate, and alkyl (C1-C4) meta-acrylate.

Main toner particles are formed by adding coloring agents, charge regulators, and wax to the binding resins. In the present embodiment, the coloring agents are yellow, magenta, cyan, and black coloring agents. Examples of charge regulators that can be used in this example include a charge regulating resin obtained by copolymerizing an ionic monomer with a copolymerizing monomer. In this case, the ionic monomer can be an ammonium salt or other monomer with an ionic functional group. The copolymerizing monomer is capable of copolymerizing with the ionic monomer and can be a styrene monomer, an acrylic monomer, or other monomer.

An external additive, such as silica, is added to the main toner particles for the purpose of increasing fluidity of the toners. Powders of various inorganic materials can be used as an external additive. For example, powders of a metallic oxide, a carbide, or a metallic salt can be used as an external additive. Examples of a metallic oxide powder that can be used as an external additive include silica, aluminum oxide (alumina), titanium oxide, strontium titanate, cerium oxide, and magnesium oxide.

In this example, toner is made from a styrene acrylic resin added with a charge regulating resin. The charge regulating resin serves as a charge regulator to impart a positively charging nature to a styrene-acrylic resin. Accordingly, toner in this example is a non-magnetic, single-component polymer toner with a positively charging nature.

An agitator 48 is provided in the lower part of the interior of the toner accommodating chamber 31. The agitator 48 is for agitating the toner in the toner accommodating chamber 31. The agitator 48 includes a rotational shaft 49 and an agitation member 50. The rotational shaft 49 is rotatably supported on two side walls 51 of the developing casing 30. The agitation member 50 is formed of a film that extends in the radial direction from the rotational shaft 49.

The rotational shaft 49 is driven to rotate by a power inputted from a motor (not shown). This causes the agitation member 50 to rotate in the clockwise direction as indicated by an arrow in the figure. When the agitation member 50 comes into contact with the inner surface of the wall of the developing casing 30, the free end portion of the agitation member 50 rubs against the inner surface of the wall of the developing casing 30 and bends towards the downstream side in the rotational direction of the agitation member 50. The agitation member 50 causes toner in the toner accommodating chamber 31 to flow toward the developing chamber 47 side.

A detection window 90 is provided in the side wall 51 at a location confronting the toner accommodating chamber 31. The detection window 90 enables detection when the amount of toner in the toner accommodating chamber 31 has fallen below a predetermined amount. A toner-empty sensor 91 (FIG. 5(*a*)) is provided on the outer side of the detection window 90. When the toner within the toner accommodating chamber 31 falls below the predetermined amount, the toner-empty sensor 91 outputs a toner-empty signal to a CPU 71 (FIG. 5(*a*)) which will be described later. The toner-empty signal is canceled when toner is replenished within the toner accommodating chamber 31 or when the developing unit 20 is replaced with a new developing unit 20.

The developing cartridge 30 has a supply-roller-upper-side wall portion 38 in the front, upper section of the developing chamber 47. The developing cartridge 30 further has a supply-roller-front-side curved wall portion 40 that extends downwardly from the supply-roller-upper-side wall portion 38. The supply roller 32 is mounted in the developing chamber 47, with its peripheral surface extending along the supply-roller-front-side curved wall portion 40.

The supply roller 32 has a roller shaft 32*a* coated by a roller portion. The roller shaft 32*a* is made of metal, and the roller portion is made of electrically conductive sponge material.

The roller shaft 32*a* is rotatably supported by the two side walls 51 of the developing casing 30. The roller shaft 32*a* is energized by a motor (not shown) to rotate in the counter-clockwise direction indicated by an arrow in the figure to execute a developing operation. At the nip between the supply roller 32 and the developing roller 33, the supply roller 32 and the developing roller 33 move in the opposite direction from each other.

The developing roller 33 is located in the front, lower part of the developing chamber 47. The developing roller 33 confronts the supply roller 32 from below. The supply roller 32 and the developing roller 33 are compressed against each other. The lower surface of the developing roller 33 is exposed through the bottom opening of the developing casing 30.

The supply roller 33 has a roller shaft 33*a* coated by a roller portion. The roller shaft 33*a* is made of metal. The roller portion is made of elastic material such as electrically conductive rubber material. More specifically, the roller portion of the developing roller 33 is a double layer structure having a roller part and a coat layer. The roller part is made of electrically-conductive rubber, such as urethane rubber, silicone rubber, or EPDM rubber, that contains carbon particles. The coat layer covers the surface of the roller portion. The coat layer is made of urethane rubber, urethane resin, or polyimide resin as a main component.

The roller shaft 33*a* is rotatably supported by the two side walls 51 of the developing casing 30. The roller shaft 33*a* is energized by the motor (not shown) to rotate in the counter-clockwise direction as indicated by an arrow in the figure to execute the developing operation. At the nip between the developing roller 3.3 and the photosensitive drum 56, the developing roller 33 and the photosensitive drum 56 move in the same direction with each other. The circumferential velocity, at which the peripheral surface of the developing roller 33 moves, is higher than or equal to 1.5 times the circumferential velocity, at which the peripheral surface of the photosensitive drum 56 moves. To execute the developing operation, the developing roller 33 is applied with a developing bias voltage by a direct current (DC) power source 75 (FIG. 5(*a*)) as will be described later.

A film member 52 is provided in the toner accommodating chamber 31. The film member 52 is in contact with the surface of the developing roller 33 with pressure. The film member 52 prevents toner from leaking through the gap between the front surface of the developing roller 33 and the front wall of the toner accommodating chamber 31.

The layer thickness regulation blade 34 is located in the downstream side of the nip between the developing roller 33 and the supply roller 32 with respect to the rotational direction of the developing roller 33. The layer thickness regulation blade 34 extends over the entire region of the width of the developing casing 30. The layer thickness regulation blade 34 includes a main blade 53 and a pressing portion 54. The main blade 53 is made from a metal plate spring.

The developing casing 30 includes a blade supporting wall portion 45. The base end of the main blade 53 is bonded to the upper surface of the blade supporting wall portion 45. The main blade 53 extends to the front side from the blade supporting wall portion 45, with its front side free end facing the upper side surface of the developing roller 33.

The pressing portion 54 is provided on the under surface of the main blade 53 at the free end thereof. The pressing portion 54 has a semi-circular shaped cross-section. The pressing portion 54 is made of an electrically insulating silicone rubber.

The pressing portion 54 is in contact with the upper surface of the developing roller 33, and is pressed against the upper surface of the developing roller 33 by an elastic force generated by the main blade 53.

The upper side surface of the developing roller 33 is in contact with the supply roller 32 at the front side of the developing roller 33 to form the nip between the developing roller 33 and the supply roller 32. The upper side surface of the developing roller 33 is also in contact with the pressing portion 54 in the rear side of the nip between the developing roller 33 and the supply roller 32. The location where the developing roller 33 contacts the pressing portion 54 is separate from the location of the nip between the developing roller 33 and the supply roller 32 by a certain amount of length. The upper side surface of the developing roller 33 contacts toner at its region defined between the contact position (nip position) with the supply roller 32 and the contact position with the pressing portion 54.

When the agitation member 50 agitates toner in the accommodating chamber 31, toner flows into the developing chamber 47. As the supply roller 32 rotates, toner is supplied by the supply roller 32 to the developing roller 33. Toner is electrically charged by friction at the location between the supply roller 32 and the developing roller 33. The surface of the supply roller 32 moves in the opposite direction from the surface of the developing roller 33. Accordingly, toner is charged efficiently when supplied from the supply roller 32 to the developing roller 33.

As the developing roller 33 rotates, the positively-charged toner borne on the surface of the developing roller 33 enters the gap between the pressing portion 54 and the developing roller 33. The thickness regulation blade 34 regulates the thickness of the toner into a predetermined amount. Thus, the toner is borne on the developing roller 33 in a layer of the predetermined amount of thickness.

The photosensitive drum units 21 are mounted in the main casing 2. The photosensitive drum units 21 are individually detachable from the main casing 2. The photosensitive drum unit 21 includes a drum casing 55. A photosensitive drum 56 and a Scorotron charger 57 are mounted in the drum casing 55. When the photosensitive drum unit 21 and the developing unit 20 for one color are mounted in the main casing 2, the photosensitive drum 56 is located facing the developing roller 33.

The drum casing 55 includes a drum accommodating frame 58 and a backing plate 59. The drum accommodating frame 58 and the backing plate 59 are integrally formed with each other. The drum accommodating frame 58 is substantially of a hollow quadrangular prism shape, whose top and bottom are both opened. The backing plate 59 extends upwardly from an upper edge of the front wall in the drum accommodating frame 58. The backing plate 59 recevies the developing casing 30 thereon.

The photosensitive drum 56 is a cylindrical tube, which is made of metal such as aluminum and whose outer surface is covered with a photosensitive layer. The photosensitive layer is made of an organic photosensitive material that contains polycarbonate as its main component. The external diameter of the photosensitive drum 56 is larger than the external diameter of the developing roller 33. The photosensitive drum 56 has a rotational shaft 60, and is rotatably supported by the two side walls of the drum accommodating frame 58 via the rotational shaft 60. The rotational shaft 60 of the photosensitive drum 56 is energized by the motor (not shown) to rotate in the clockwise direction indicated by an arrow in the figure to receive a toner image from the developing roller 33. Thus, the surface of the photosensitive drum 56 moves in the same direction with the conveyor belt 67 at the nip between the photosensitive drum 56 and the conveyor belt 67.

It is noted that a laser beam from the scanning unit 19 can reach a position within a predetermined region on the surface of the photosensitive drum 56. The predetermined region will be referred to as a latent-image formable region on the surface of the photosensitive drum 56.

The Scorotron charger 57 is fixed to the rear wall of the drum accommodating frame 58. The Scorotron charger 57 is located in the rear side of the photosensitive drum 58, and is separate from the photosensitive drum 58 by a certain amount of distance. The Scorotron charger 57 is of a positively charging type, and has a wire made of tungsten, for example, for generating a corona discharge. The Scorotron charger 57 is applied with an electric voltage by a power source (not shown) to charge the surface of the photosensitive drum 56 electrically positively.

As the photosensitive drum 56 rotates, the Scorotron charger 57 electrically charges the entire surface of the photosensitive drum 56 uniformly to a positive polarity. As a result, the latent-image formable region on the surface of the photosensitive drum 56 is uniformly charged to a positive polarity Accordingly, the entire latent-image formable region has a surface potential of a predetermined positive value.

As the photosensitive drum 56 further rotates, the latent-image formable region is selectively exposed to a high-speed scan of a laser beam from the scanner unit 19. Electric charge is removed from the surface of the photosensitive drum 57 at portions where the laser beam is irradiated. The electric potential on the surface of the photosensitive drum 56 drops at the laser-irradiated area in the latent-image formable region. The thus formed lower-potential areas in the latent-image formable region form an electrostatic latent image on the surface of the photosensitive drum 56. Because the intensity of the laser beam is fixed in the present embodiment, the lower-potential areas in the latent-image formable region have a predetermined surface potential.

As the photosensitive drum 56 rotates, positively-charged toner that is born on the surface of the developing roller 33 is brought into contact with the electrostatic latent image formed on the photosensitive drum 56. As a result, the positively-charged toner is supplied from the developing roller 33 to the lower-potential areas on the surface of the photosensitive drum 56. Thus, toner is selectively borne on the photosensitive drum 56, and the electrostatic latent image is developed into a visible toner image through a reverse development method.

It is noted that an electrostatic latent image potential is defined as the surface potential of the electrostatic latent image formed on the photosensitive drum 56, on which a laser beam has been irradiated and therefore from which an electric charge is removed. According to the present embodiment, the electrostatic latent image potential has a predetermined value. An effective developing bias voltage is defined as a difference between the electrostatic latent image potential and the developing bias voltage that is applied to the developing roller 33 from the DC power source 75.

According to the present embodiment, the above-described reverse development occurs in each of the four processing units 16. Accordingly, visible images with the four color toners are formed by the four processing units 16, respectively.

Next, the transferring section 17 will be described in detail with reference back to FIG. 2.

The transferring section 17 is disposed in the main casing 20 at a location in the opposite side of the developing units 20 with respect to the drum units 21. Because the developing units 20 are located above the drum units 21 in the vertical direction, the transferring section 17 is disposed below the drum units 21 in the vertical direction. The transferring section 17 confronts the photosensitive drums 56 in the drum units 21.

The transfer section 17 includes: a drive roller 65, a follower roller 66, the conveyor belt 67, and a plurality of (four, in this example) transfer rollers 68.

The drive roller 65 is disposed in the front side of the photosensitive drum 56 in the yellow process unit 16Y. The follower roller 66 is disposed in the rear side of the photosensitive drum 56 in the black process unit 16K.

The conveyor belt 67 is a conductive endless belt. The conveyor belt 67 is formed of polycarbonate or polyimide resin, with electrically conductive particles such as carbon being dispersed therein. The conveyor belt 67 is wound around the drive roller 65 and the follower roller 66. The outside surface of the conveyor belt 67 wound on the drive roller 65 and the follow roller 66 is in confrontation with and in contact with the photosensitive drums 56 in all the process units 16.

When the drive roller 65 rotates in the counterclockwise direction, the conveyor belt 67 moves circumferentially around the drive roller 65 and the follower roller 66 to rotate in the counterclockwise direction. Accordingly, the upper side portion of the conveyor belt 67 moves in the same direction with the photosensitive drums 56 at its image transfer positions where the upper side portion of the conveyor belt 67 are in contact with the photosensitive drums 56.

In the loop of the conveyor belt 67 wound around the drive roller 65 and the follower roller 66, the four transfer rollers 68 are provided in confrontation with the photosensitive drums 56 via the upper side portion of the conveyor belt 67. Each transfer roller 68 includes a metal roller shaft covered by a roller portion made of an elastic material such as an electrically conductive rubber. The transfer rollers 67 are rotatable in the counterclockwise direction. Accordingly, the transfer rollers 67 move in the same direction with the conveyor belt 67 at the positions where the transfer rollers 68 contact the conveyor belt 67. The transfer rollers 68 are applied with a transfer bias by the power source (not shown) to transfer a toner image from the photosensitive drums 56 onto the conveyor belt 67.

A paper 3 is transferred from the paper supplying section 4 to the transfer rollers 14. As the conveyor belt 67 moves by the rotation of the drive roller 65 and the follow roller 66, the paper 3 passes through the nips between the conveyor belt 67 and the photosensitive drums 56 successively. As a result, toner images of the four colors are transferred onto the paper 3 from the photosensitive drums 56 in the process units 16 in an overlapping state. Thus, a multi-color image is formed on the paper 3.

More specifically, a multi-color image is formed on the paper 3 by first transferring onto the paper 3 a yellow toner image, which is supported on the surface of the photosensitive drum 56 in the yellow process unit 16Y, then transferring a magenta toner image, which is supported on the surface of the photosensitive drum 56 in the magenta process unit 16M, onto the yellow toner image that is now supported on the paper 3, and similarly transferring a cyan toner image, supported on the surface of the photosensitive drum 56 in the cyan process unit 16C, and a black toner image, supported on the surface of the photosensitive drum 56 in the black process unit 16K, onto the previous images thereon.

A reflectance sensor 74 is disposed above the rear end of the conveyor belt 67 and on the downstream side of the black process unit 16K in the direction in which the paper 3 is fed, The reflectance sensor 74 is for detecting the value of reflectance I of an object that has been conveyed by the conveyor belt 67 to a location in confrontation with the reflectance sensor 74. The reflectance I is defined as a ratio of an amount of light that reflects off the object with respect to the total amount of light that has fallen incident on the object.

Reflection density is defined for a toner image that is formed on a sheet of paper by the following equation:

$$(\text{Reflection density}) = -\log_{10}\{(\text{reflectance of a background portion of the sheet of paper where the toner image is not formed}) - (\text{reflectance of a part of the sheet of paper where the toner image is formed})\}$$

It is noted that transmittance of an object is defined as a ratio of an amount of light that passes through the object with respect to the total amount of light that has fallen incident on the object. Transmission density is defined for a toner image that is formed on a sheet of paper by the following equation:

$$(\text{Transmission density}) = -\log_{10}\{(\text{transmittance of a part of the sheet of paper where the toner image is formed})\}$$

The transmission density has a value that is proportional to the quantity of toner adhering to the sheet of paper per unit area.

The color laser printer 1 is of a tandem-type that includes the photosensitive drums 56 of four colors. An image of each color is formed substantially at the same speed as when a monochrome image is formed. Thus, the color laser printer 1 achieves quick color image formation.

The fixing section 18 will be described below.

The fixing section 18 is disposed in the rear side of the process units 16 and the transferring section 17 and in the downstream side of the process units 16 and the transferring section 17 in the sheet conveying direction.

The fixing section 18 includes a heat roller 70 and a pressure roller 69.

The heat roller 70 is configured of a metal tube with a release layer formed on the surface thereof. The heat roller 70 accommodates therein a halogen lamp extending along the direction of the axis of the heat roller 70. The halogen lamp heats the surface of the heat roller 70 to a fixing temperature. The pressure roller 69 contacts the heat roller 70 with pressure.

In the fixing portion 18, the recording paper 3 with the multi-color toner image formed thereon passes in between the heat roller 70 and the pressure roller 69, and the multi-color toner image is thermally fixed onto the sheet of paper 3 with pressure.

The paper discharging section 6 includes: the paper discharge opening 9, the discharge tray 10, and the discharge rollers 11. The paper 3 from the fixing section 18 is discharged by the discharge rollers 11 through the paper discharge opening 9 outside the main casing 2, and is stacked on the discharge tray 10.

When the entire area of the latent-image formable region on the photosensitive drum 56 for some color is uniformly irradiated with a laser beam, an electrostatic latent image is formed entirely over the latent-image formable region. In this case, when the latent-image formable region confronts the developing roller 33, a solid image is formed on the photosensitive drum 56 at its entire latent-image formable region by the corresponding toner and is transferred onto a sheet of paper.

On the other hand, when no area of the latent-image formable region on the photosensitive drum 56 is irradiated with a laser beam, no electrostatic latent image is formed in the latent-image formable region. In this case, when the latent-image formable region confronts the developing roller 33, a blank image is formed on the photosensitive drum 56 at the latent-image formable region by the corresponding toner and is transferred onto a sheet of paper.

As shown in FIG. 3, a location A is defined on the surface of the developing roller 33 in the rotating direction of the developing roller 33. The location A is downstream from a point where the developing roller 33 contacts the pressing portion 54 and upstream from the point where the developing roller 33 contacts the photosensitive drum 56.

According to the present embodiment, the amount of the charge regulator (charge regulating resin, in this example) that is added to the toner (styrene acrylic resin, in this example) is adjusted to satisfy the following condition (1):

(1) The quantity of charge per unit mass (q/m) of toner that is supported on the surface of the developing roller 33 at the location A immediately after a solid image has been formed on the photosensitive drum 56 and the quantity of charge per unit mass (q/m) of toner that is supported on the surface of the developing roller 33 at the location A immediately after a blank image has been formed on the photosensitive drum 56 are equal to each other and have the value of greater than or equal to 10 μC/g.

It is noted that by increasing the added amount of the charge regulator, toner becomes more likely to be electrically charged. It is preferable to form the entire components of the toner, including resin (main component) and external additive, from such material that is likely to be electrically charged to the same polarity (positive polarity, in this example). The external additive may preferably be subjected to a surface treatment so that the resultant toner will become more likely to be electrically charged. Thus, the condition (1) can be attained by selecting the material of the components of toner, by controlling the amount of the charge regulator, and by subjecting the external additive to a surface treatment if necessary.

It is also noted that toner will possibly have such characteristics that the charge amount of the toner will decrease as the toner is repeatedly used for image formation operation. In this case, when toner has been used for a relatively long time and therefore the charge amount becomes lower than 10 μC/g, it is necessary to replenish new toner to the toner accommodating chamber 31 in order to satisfy the condition (1).

Additionally, the amount of the external additives added in the toner is adjusted to satisfy the following condition (2):

(2) The mass per unit area of toner (m/a) that is supported on the surface of the developing roller 33 at a location A immediately after a solid image has been formed on the photosensitive drum 56 is less than the mass per unit area of toner (m/a) that is supported on the surface of the developing roller 33 at the location A immediately after a blank image has been formed on the photosensitive drum 56.

For example, the condition (2) can be satisfied by increasing the amount of external additives with a particle diameter of greater than or equal to 50 nm, while decreasing the amount of other external additives with a particle diameter smaller than 50 nm, thereby reducing fluidity of toner.

Figure 4:
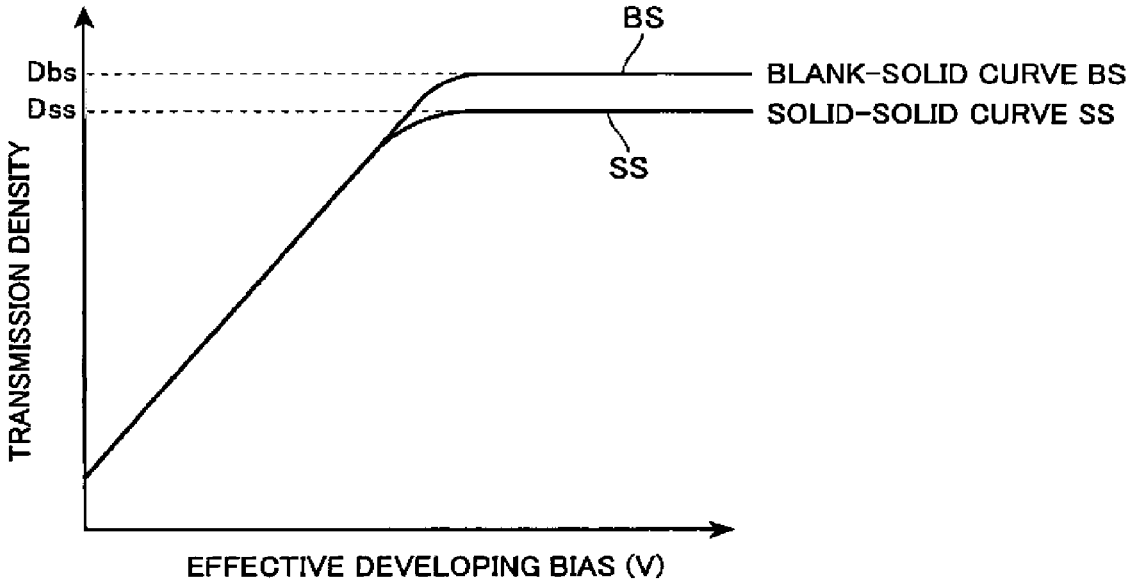
FIG. 4 is a graph showing the relationship between the effective developing bias voltage and the transmission density in the color laser printer of FIG. 2.

Because the above-described conditions (1) and (2) are fulfilled, the developing system configured of the developing roller 33 and the photosensitive drum 56 attains the relationship between the effective developing bias voltage and the transmission density as shown in FIG. 4.

More specifically, when the developing system forms a solid image (second solid image) immediately after forming another solid image (first solid image), the second solid image has the relationship between the effective developing bias voltage and the transmission density as indicated by a solid-solid curve SS in FIG. 4. On the other hand, when the developing system forms a solid image immediately after forming a blank image, the solid image has the relationship between the effective developing bias voltage and the transmission density as indicated by a blank-solid curve BS in FIG. 4.

As apparent from the FIG. 4, the solid-solid curve SS indicates that the transmission density increases in proportion to the effective developing bias voltage when the effective developing bias voltage is relatively low, and is saturated to a value Dss when the effective developing bias voltage becomes relatively high. Similarly, the blank-solid curve BS indicates that the transmission density increases in proportion to the effective developing bias voltage when the effective developing bias voltage is relatively low, and is saturated to a value Dbs when the effective developing bias voltage becomes relatively high.

Because the conditions (1) and (2) are met, the proportional constant of the solid-solid curve SS is equal to the proportional constant Pbs of the blank-solid curve BS. In other words, the solid-solid curve SS and the blank-solid curve BS have the same slope (1/dV) of transmission density relative to the effective developing bias voltage as shown in FIG. 4.

It is noted that development of toner can be approximated by an equation of Q=C×V, where Q is the total amount of an electric charge per unit area that is transferred from the developing roller 33 to the photosensitive drum 56, C is a capacitance of the photosensitive layer of the photosensitive drum 56, and V is the effective developing bias voltage. It is therefore known that if some fixed amount of effective developing bias voltage is applied between the electrostatic latent image portions on the photosensitive drum 56 and the developing roller 33, the amount of the mass of toner per unit area that is transferred onto the photosensitive drum 56 decreases as the amount of charge of toner per unit mass (q/m) increases. Accordingly, the proportional constant in each curve in FIG. 4 will decrease as the amount of charge of toner per unit mass (q/m) increases, and will increase as the amount of charge of toner per unit mass (q/m) decreases. In other words, the proportional constant in each curve in FIG. 4 will not change if the amount of charge of toner per unit mass (q/m) is fixed. According to the present embodiment, because the condition (1) is met, the proportional constant of the solid-solid curve SS is equal to that of the blank-solid curve BS.

The amount of toner that can be supplied from the developing roller 33 to the photosensitive drum 56 is determined dependently on a product of the amount of toner per unit area that is borne on the developing roller 33 and the rate of the peripheral speed of the developing roller 33 relative to the peripheral speed of the photosensitive drum 56. If a sufficiently-large amount of toner can be supplied from the developing roller 33 to the photosensitive drum 56, each curve SS, BS will maintain its proportional relationship between the effective developing bias voltage and the transmission density even when the effective developing bias voltage increases to a high value. If not, however, each curve SS, BS will be saturated when the effective developing bias voltage increases to a relatively high value.

According to the present embodiment, the peripheral speed of the developing roller 33 is set to be greater than or equal to 1.5 times that of the photosensitive drum 56 in order to increase the amount of toner that can be supplied from the developing roller 33 to the photosensitive drum 56 and to widen the range where the curves SS, SB have the proportional characteristics as wide as possible. Still, each curve SS, SB is saturated when the effective developing bias voltage increases to some relatively high value.

Because the condition (2) is met, the amount of toner that is supported on the developing roller 33 after a solid image has been formed on the photosensitive drum 56 is smaller than the amount of toner that is supported on the developing roller 33 after a blank image has been formed on the photosensitive drum 56. This ensures that toner that is supported on the developing roller 33 after a solid image has been formed will become electrically charged more easily than toner that is supported on the developing roller 33 after a blank image has been formed. This ensures that the condition (1) will be met and therefore that the proportional constant of the solid-solid curve SS will be equal to the proportional constant of the blank-solid curve BS. Additionally because the condition (2) is met, the saturated transmission-density value Dss in the solid-solid curve SS is lower than the saturated transmission-density value Dbs in the solid-blank curve SB.

According to the present embodiment, a target transmission density Dr is set within a region in which the transmission density is proportional to the effective developing bias voltage both in the solid-solid curve SS and in the blank-solid curve BS. The amount of the effective developing bias voltage is controlled to attain the target transmission density Dr based on the proportional relationship between the effective developing bias voltage and the transmission density, that is, based on the slope of the transmission density with respect to the effective developing bias voltage.

This ensures that a substantially constant amount of toner will be transferred onto the photosensitive drum 56 to form an image, regardless of whether any image (a blank image, a solid image, for example) has been formed immediately before the subject image is formed. As a result, images can be formed on the paper 3 stably at the target transmission density Dr.

Figure 5A:
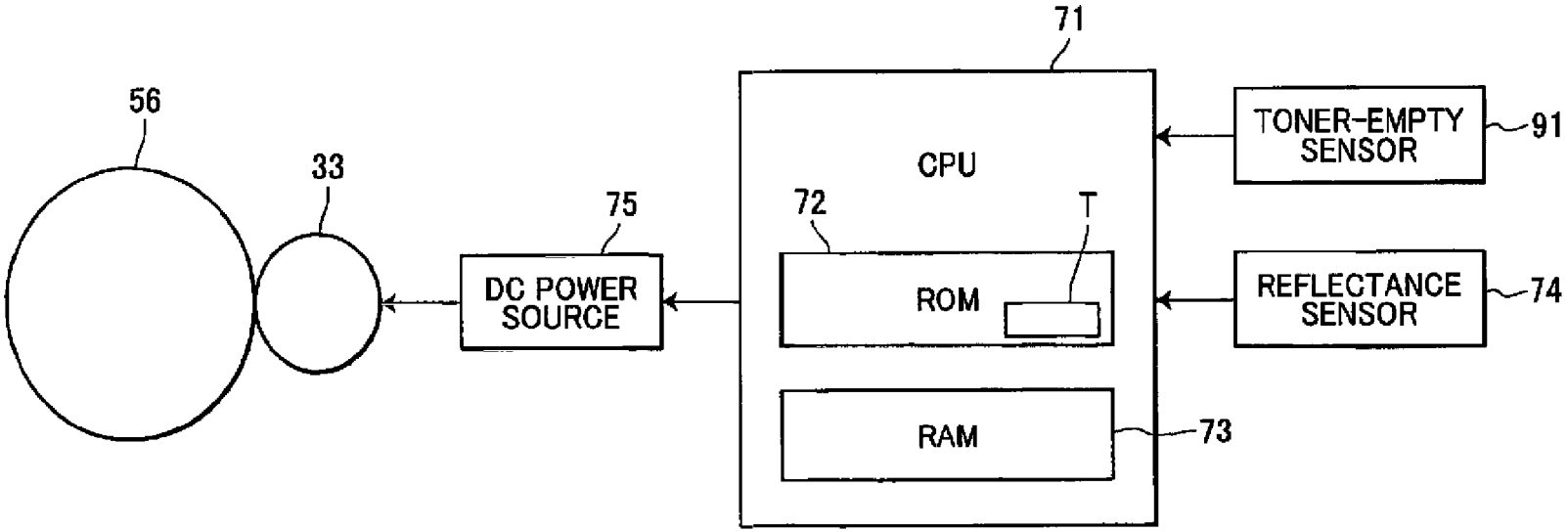
FIG. 5(*a*) is a block diagram of a control system for controlling the value of the effective developing bias voltage in the color laser printer of FIG. 2.
Figure 5B:
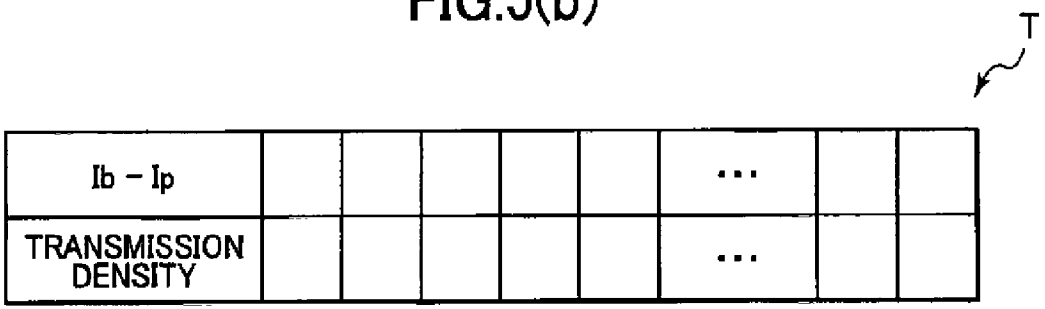

As shown in FIG. 5(*a*), the color laser printer 1 is provided with a CPU 71 for controlling the value of the effective developing bias voltage.

The reflectance sensor 74 is connected to the CPU 71. The reflectance sensor 74 generates a detection signal, which is inputted to the CPU 71. The detection signal is indicative of reflectance I of an object that is located in confrontation with the reflectance sensor 74. For example, when a sheet of paper with no image being formed is in confrontation with the reflectance sensor 74, the reflectance sensor 74 generates a detection signal that is indicative of reflectance Ib of the sheet of paper, per se. The reflectance Ib will be referred to as "background reflectance Ib" hereinafter. On the other hand, when some solid image (patch), which is formed on a sheet of paper by one color, is in confrontation with the reflectance sensor 74, the reflectance sensor 74 generates a detection signal that is indicative of reflectance Ip of the patch. The reflectance Ip will be referred to as "patch reflectance Ip" hereinafter.

The CPU 71 is provided with a ROM 72 and a RAM 73. The ROM 72 stores therein a program (FIG. 8(*a*) and FIG. 8(*b*)) for controlling the value of the effective developing bias voltage. The ROM 72 further stores therein: four transmission-density conversion tables T in one to one correspondence with all the four colors; data of four target transmission densities Dr in one to one correspondence with all the four colors; data of four default effective developing bias voltages Vta in one to one correspondence with all the four colors; and data of four default effective developing bias voltages Vtb in one to one correspondence with all the four colors.

As shown in FIG. 5(*b*), the transmission-density conversion table T for each color lists up a plurality of transmission density values D in one-to-one correspondence with a plurality of different values of differences between the background reflectance Ib and the patch reflectance Ip.

Figure 8A:
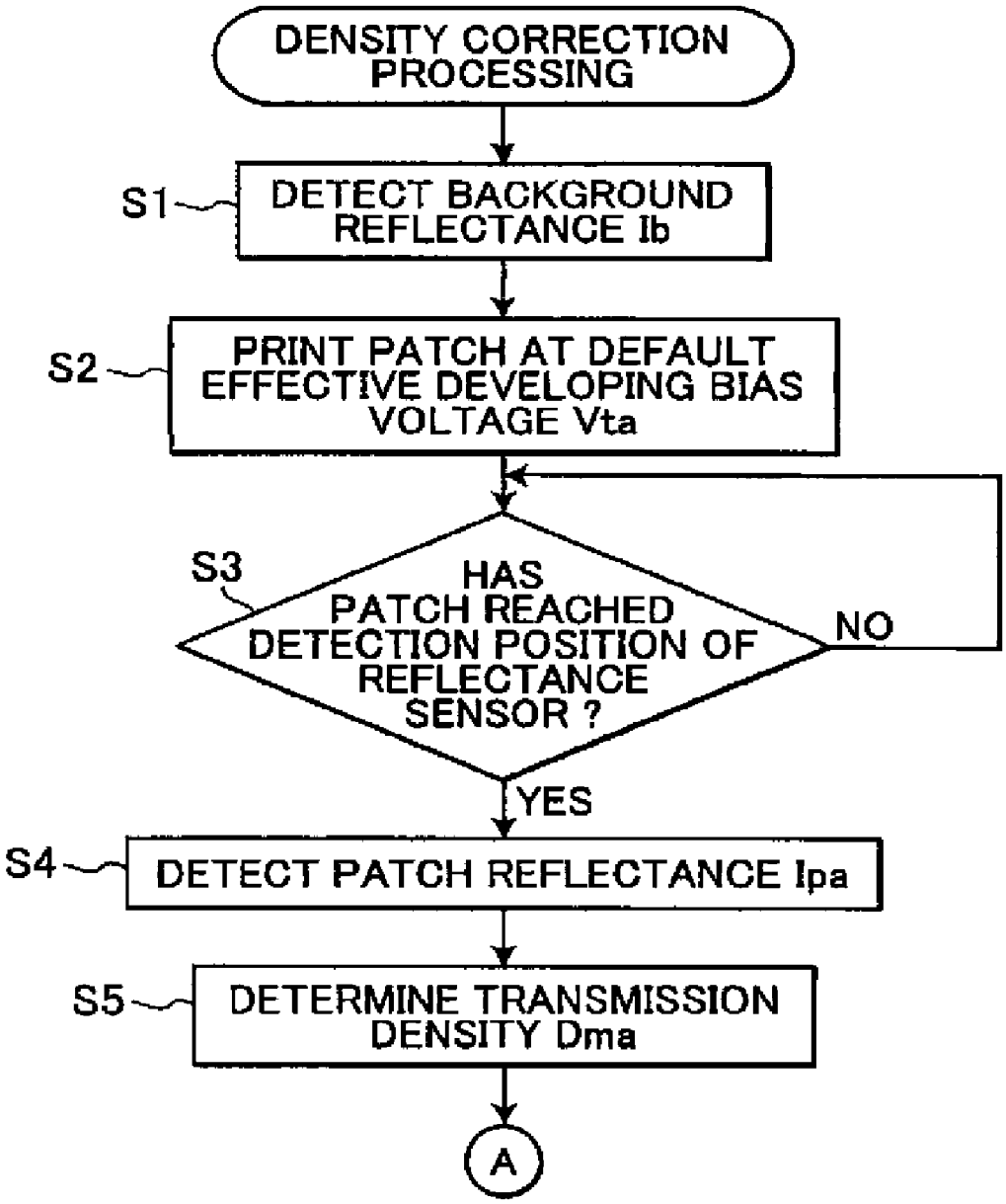
FIG. 8(*a*) is a part of a flowchart of a density correction processing executed by the color laser printer of FIG. 2.
Figure 8B:
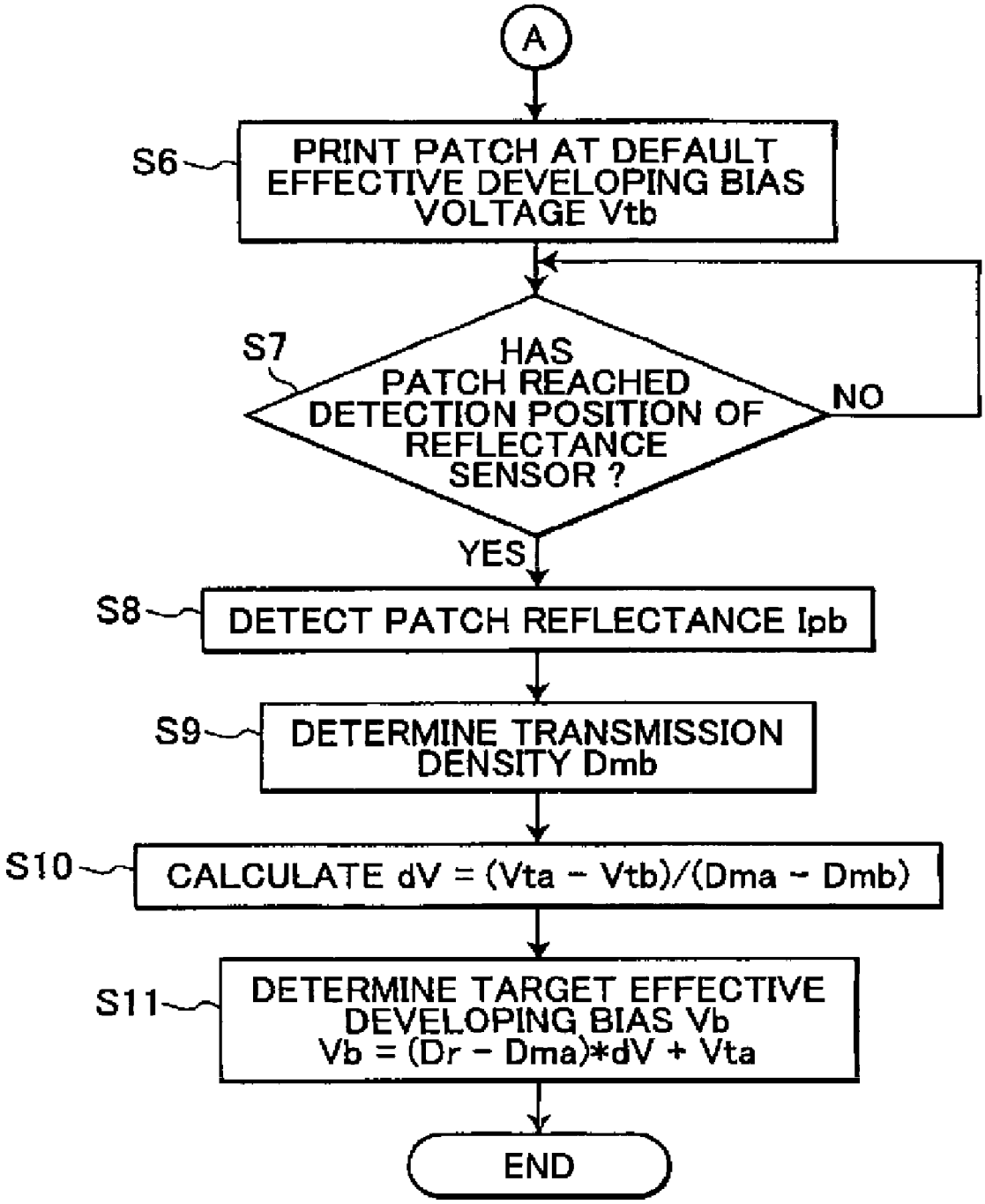

The program of FIGS. 8(*a*)-8(*b*), the transmission-density conversion table T, the target transmission density Dr, and the default effective developing bias voltages Vta and Vtb are stored beforehand for each color.

The RAM 73 functions as a work area that is used for temporarily storing data such as numerical values when the CPU 71 executes the program stored in the ROM 72.

A DC power source 75 is connected to the CPU 71. The DC power source 75 is for generating the developing bias voltage, and for applying the developing roller 33 with the developing bias voltage. The CPU 71 controls the DC power source 75 as a target of control. That is, the CPU 71 executes the density correction processing of FIG. 8(*a*) and FIG. 8(*b*) in accordance with the program stored in the ROM 72 to control the DC power source 75 to apply the developing roller 33 with a controlled developing bias voltage.

Next will be described how to determine the transmission-density conversion table T, the target transmission density Dr, and the default effective developing bias voltages Vta and Vtb for each color.

Before the color laser printer 1 is shipped from the manufacturer, the transmission-density conversion table T, the target transmission density Dr, and the default effective developing bias voltages Vta and Vtb are determined for each color and are stored in the ROM 72.

It is noted that the transmission-density conversion tables T, the target transmission densities Dr, and the default effective developing bias voltages Vta and Vtb for all the colors are determined in the same manner. Accordingly, the following description will be directed to one color (which will be referred to as "target color" hereinafter).

First, reflectance Ib of a predetermined kind of standard paper is measured by using the reflectance sensor 74.

Next, one process unit 16 for the target color is controlled to execute a patch formation operation to form a plurality of solid images (patches) on the standard paper, while varying the effective developing bias voltage to various different values. The process units 16 for other colors are controlled not to perform any image formation operation.

Next, a transmission density-determining operation is executed to determine the transmission densities of the patches by measuring the transmittance of the patches and by calculating the formula of (transmission density)=$-\log_{10}$(transmittance). It is noted that the transmittance of the patches is measured by using a transmittance-measuring device that is prepared separately from the color laser printer 1. A voltage-transmission density curve is determined as shown in FIG. 6 by plotting the transmission densities relative to the effective developing bias voltages.

Next, a reflection density-determining operation is executed to determine the reflection densities of the patches by measuring the patch reflectance Ip of the patches and by calculating the formula of (Reflection density)=$-\log_{10}$(Ib−Ip). A transmission density-reflection density curve is determined as shown in FIG. 7 by plotting the reflection densities relative to the transmission densities.

Figure 6:
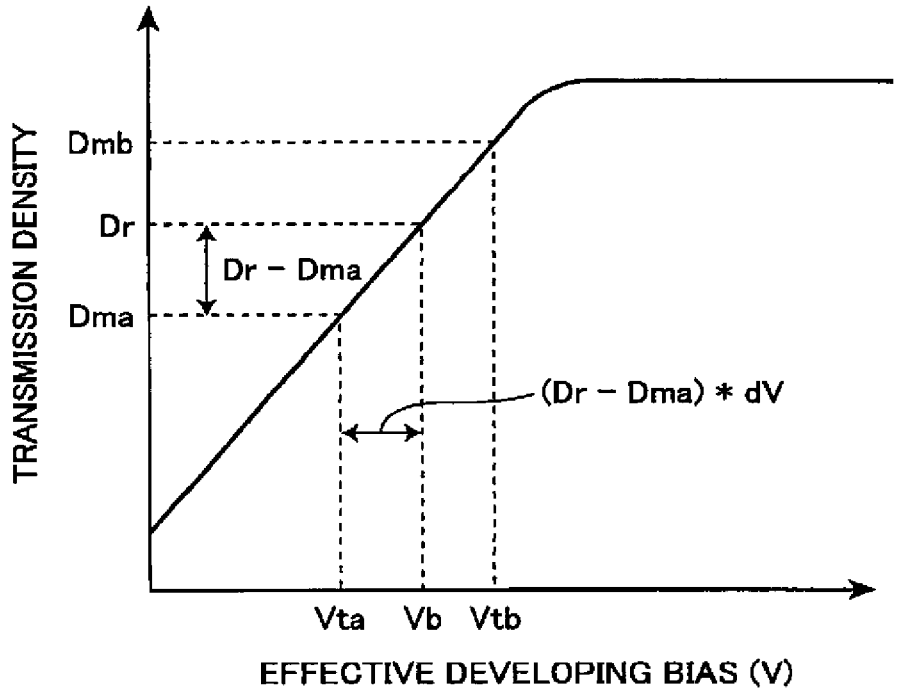
FIG. 6 is a graph showing the relationship between the effective developing bias voltage and the transmission density and indicating default effective developing bias voltages and a target effective developing bias voltage.

Based on the graph of FIG. 6, the target transmission density Dr and the default effective developing bias voltages Vta and Vtb are determined, and are stored in the ROM 72. More specifically, the default effective developing bias voltages Vta and Vtb are determined so that corresponding transmission densities Dma and Dmb are out of the range where the transmission density is saturated. The target transmission density Dr is determined also as being out of the saturated range. In this way, the default effective developing bias voltages Vta and Vtb and the target transmission density Dr are determined in the range where the transmission density is in proportion to the effective developing bias voltage. It is noted that the default effective developing bias voltages Vta and Vtb and the target transmission density Dr are determined so that the target transmission density Dr is between the transmission densities Dma and Dmb for the default effective developing bias voltages Vta and Vtb.

Figure 7:
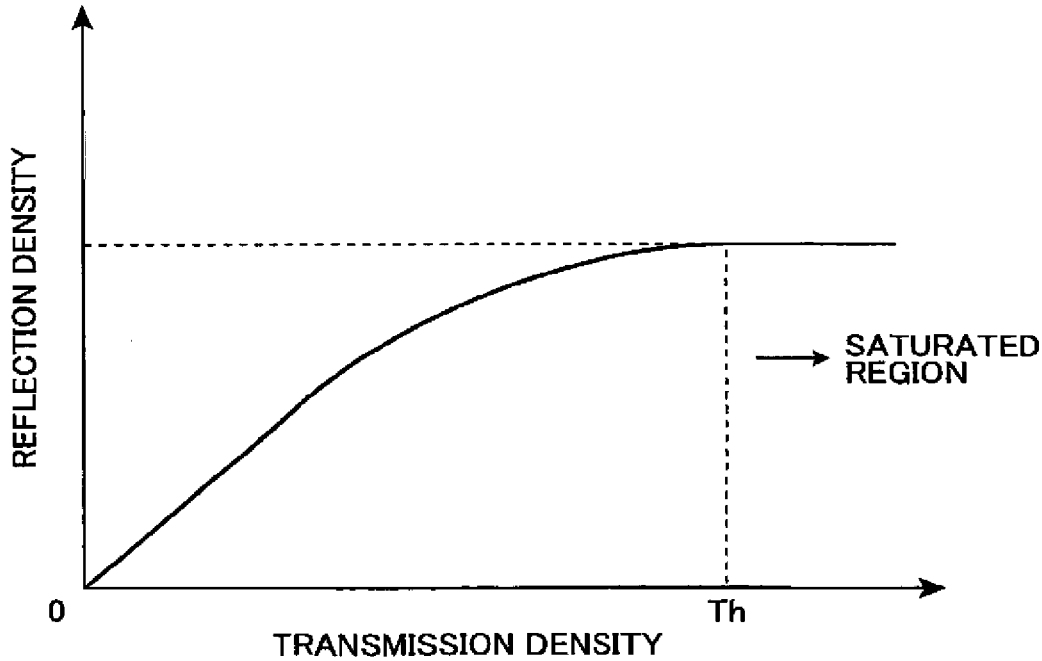
FIG. 7 shows the relationship between the transmission density and the reflection density.

Additionally, the relationship between the difference (Ib−Ip) and the transmission density is determined based on the graph of FIG. 7 and based on the relationship (reflection density=$\log_{10}$(Ib−Ip)) between the reflection density and the reflectance difference (Ib−Ip) The thus determined relationship between the difference (Ib−Ip) and the transmission density is stored as the transmission-density conversion table T as shown in FIG. 5(*b*), and is stored in the ROM 72.

After a user purchases the color laser printer 1, the CPU 71 executes a density correction processing for each color every time before starting image formation operation.

Next will be described, with reference to FIG. 8(*a*)-FIG. 8(*b*), the density correction processing of the present embodiment.

It is noted that the density correction processing is the same for all the colors. Accordingly, the density correction processing will be described below for one color (which will be referred to as a "target color" hereinafter).

As shown in FIG. 8(*a*), during the density correction processing, first, in S1, the CPU 71 controls a sheet of paper 3 to be fed out from the paper supply tray 12, while controlling all the processing units 16 to perform no image formation operation. When the paper 3 reaches the reflectance sensor 74, the reflectance sensor 74 detects the background reflectance Ib of the paper 3.

Next, in S2, the CPU 71 controls the DC power source 75 to apply the developing roller 33 for the target color with a first default developing bias voltage that is determined by adding the first default effective developing bias voltage Vta to the predetermined electrostatic latent image potential. A sheet of the paper 3 is fed, and a solid image (patch) of the target color is printed on the paper 3. It is noted that the process units 16 for other colors are controlled not to perform any image formation operation.

The paper 3 passes through the process units 16 until the paper 3 reaches the detection position of the reflectance sensor 74 (YES in S3). Then in S4, the reflectance sensor 74 detects patch reflectance Ipa of the patch.

Subsequently, in S5, the CPU 71 calculates the difference (Ib−Ipa) between the background reflectance Ib and the patch reflectance Ip. The CPU 71 then determines a transmission density Dma of the patch based on the difference (Ib−Ipa), while referring to the transmission-density conversion table T.

Next, as shown in FIG. 8(*b*), the CPU 71 controls in S6 the DC power source 75 to apply the developing roller 33 for the target color with a second default developing bias voltage that is determined by adding the second default effective developing bias voltage Vtb to the predetermined electrostatic latent image potential. A sheet of the paper 3 is fed, and a solid image (patch) of the target color is printed on the paper 3. The process units 16 for other colors are controlled not to perform any image formation operation.

The paper 3 passes through the process units 16 until the paper 3 reaches the detection position of the reflectance sensor 74 (YES in S7). Then, in S8, the reflectance sensor 74 detects patch reflectance Ipb of the patch.

Subsequently, in S9, the CPU 71 calculates the difference (Ib−Ipb) between the background reflectance Ib and the patch reflectance Ip. The CPU 71 then determines a transmission density Dmb of the patch based on the difference (Ib−Ipb), while referring to the transmission-density conversion table T.

Next, in S10, the CPU 71 determines the reciprocal (dV) of the slope (1/dV) by calculating the following formula (3):

$$dV=(Vta-Vtb)/(Dma-Dmb) \quad (3)$$

Then, in S11, the CPU 71 determines a target effective developing bias voltage Vb in accordance with the following Equation (4):

$$Vb=(Dr-Dma)*dV+Vta \quad (4)$$

As shown in FIG. 6, two points that correspond to the transmission density Dma and the target transmission density Dr are located on the part of the voltage/transmission density curve where the transmission density is in proportion to the effective developing bias voltage. The product "(Dr−Dma) *dV" indicates the distance between the two points in the horizontal axial direction. Thus, the target effective developing bias voltage Vb for the target transmission density Dr is determined by adding, to the product "(Dr−Dma)*dV", the default effective developing bias voltage Vta that has attained the transmission density Dma.

After determining the target effective developing bias voltage Vb, the CPU 71 determines the value of the developing bias voltage to be applied to the developing roller 33 for the target color by adding the target effective developing bias voltage Vb to the predetermined electrostatic latent image potential.

The CPU 71 executes the above-described density correction processing for each of all the colors, to determine the developing bias voltage for each color. Thereafter, the CPU 71 controls the DC power source 75 to apply the developing roller 33 for each color with the determined developing bias voltage, and starts executing image formation operation. This ensures that the color laser printer 1 will form an image of each color at its corresponding target transmission density Dr on papers 3.

As described above, according to the present embodiment, toner is electrically charged by friction between the supply roller 32 and the developing roller 33 so that it has a charge of at least 10 μC/g. Thus, toner supported on the surface of the developing roller 33 can be transferred stably onto the surface of the photosensitive drum 56. For that reason, the density of an image formed on the paper 3 can be made stable.

In addition, the peripheral speed of the developing roller 33 is set to be at least 1.5 times that of the photosensitive drum 56. With this configuration, toner supported on the surface of the developing roller 33 can be transferred even more smoothly onto the surface of the photosensitive drum 56. For that reason, the density of images formed on the paper 3 can be made even more stable.

Because the effective developing bias voltage is controlled for the processing units 16 individually, images can be formed with stable image density in the respective colors.

Modification

As shown in FIG. 7, the reflection density increases as the transmission density increases, and is finally saturated to a constant value when the transmission density reaches some threshold value Th. Setting the target transmission density Dr in the region in which the reflection density is saturated ensures that images with stable density will be formed without being affected by the base color of the paper 3.

According to the present modification, therefore, in order to form images at an even more stable density, the target transmission density Dr is set within a region, in which the transmission density is in proportion to the effective developing bias voltage in FIG. 6 and also in which the reflection density is saturated in FIG. 7. More specifically, the target transmission density Dr is set to be greater than the threshold value Th and within the region, in which the transmission density is in proportion to the effective developing bias voltage in FIG. 6.

Similarly, the first and second default effective developing bias voltages Vta and Vtb are set within a region, in which the transmission density is in proportion to the effective developing bias voltage in FIG. 6 and also in which the reflection density is saturated in FIG. 7. More specifically, the first and second default effective developing bias voltages Vta and Vtb are set to be greater than the threshold value Th and within the region, in which the transmission density is in proportion to the effective developing bias voltage in FIG. 6.

Second Embodiment

Next, a second embodiment will be described with reference to FIG. 9-FIG. 11.

Figure 9:
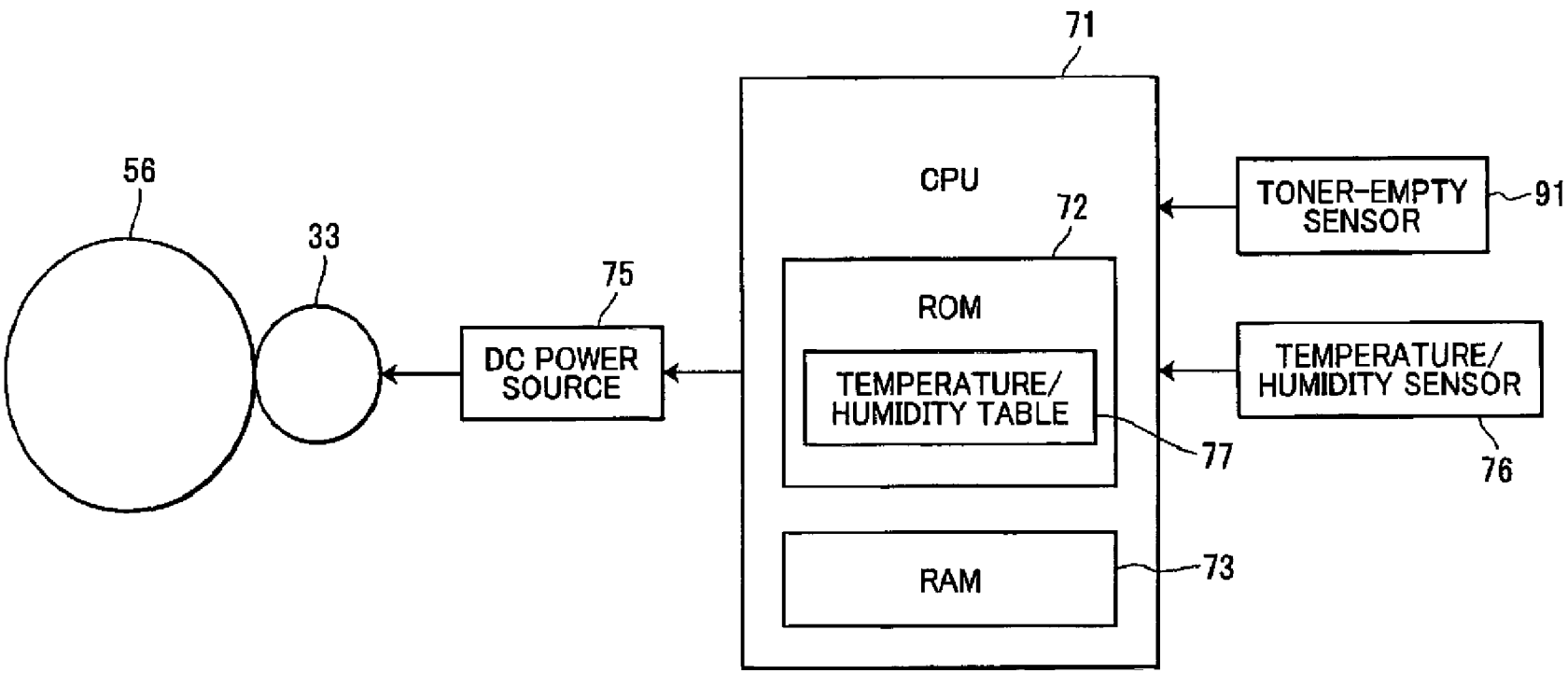
FIG. 9 is a block diagram of a control system for controlling the value of the effective developing bias voltage based on a temperature/humidity table according to a second embodiment of the present invention.

The control system according to the second embodiment is shown in FIG. 9, and is different from that of the first embodiment (FIG. 5(*a*)) as described below. In FIG. 9, portions corresponding to components in FIG. 5(*a*) are denoted by the same reference numerals as those used in FIG. 5(*a*).

According to the present embodiment, the reflectance sensor 74 is not provided in the color laser printer 1, and the ROM 72 does not store the program of FIG. 8(*a*)-8(*b*), the transmission-density conversion tables T, the target transmission densities Dr, or the default effective developing bias voltages Vta and Vtb. Instead, a temperature/humidity sensor 76 is mounted in the color laser printer 1, and is connected to the CPU 71. The temperature/humidity sensor 76 is for detecting the ambient temperature and relative humidity around the color laser printer 1. A detection signal of the temperature/humidity sensor 76 is inputted to the CPU 71.

According to the present embodiment, the ROM 72 stores therein four temperature/humidity tables 77 in one to one correspondence with all the four colors. The temperature/humidity tables 77 for all the colors are stored in the ROM 72 beforehand.

Figures 10, 11:
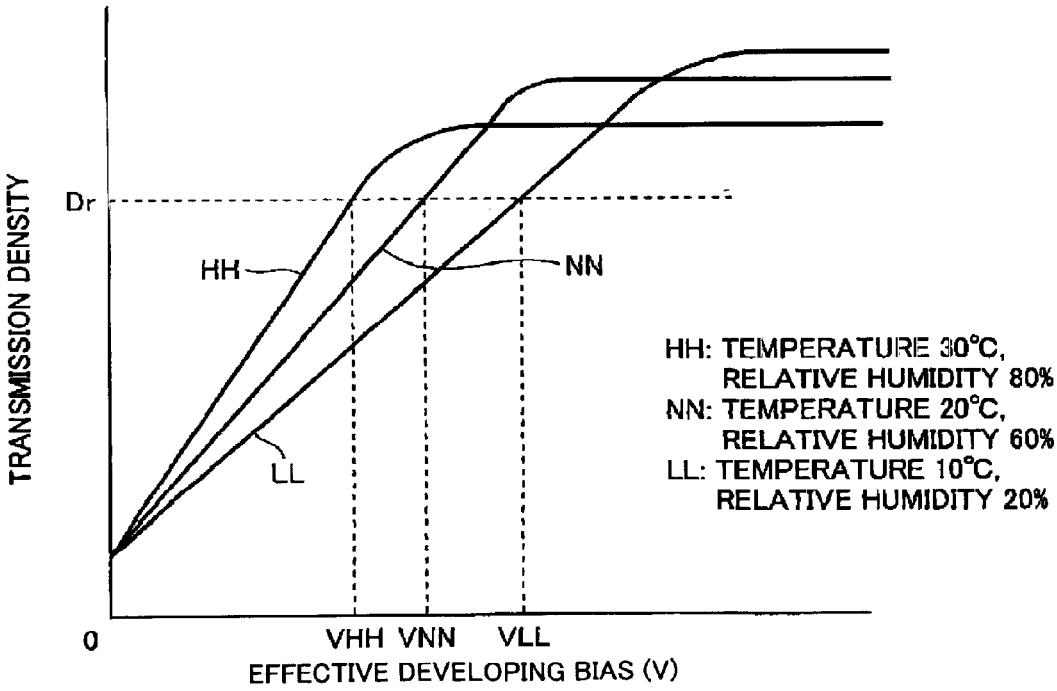
FIG. 10 shows details of the temperature/humidity table of FIG. 9.
FIG. 11 illustrates a plurality of relationships between the effective developing bias voltage and the transmission density for a plurality of different combinations of temperature and relative humidity to indicate how to create the temperature/humidity table of FIG. 9.

As shown in FIG. 10, the temperature/humidity table 77 for each color lists up a plurality of target effective developing bias voltages in one-to-one correspondence with a plurality of different combinations of the temperature and relative humidity. In this example, the plurality of different temperature/humidity combinations include 36 different combinations for temperature of 10° C., 15° C., 20° C., 25° C., 30° C., and 35° C. and relative humidity of 0%, 20%, 40%, 60%, 80%, and 100%.

Next will be described with reference to FIG. 11 how to create the temperature/humidity table 77. Before the color laser printer 1 is shipped from the manufacturer, the temperature/humidity table 77 is created for each color and is stored in the ROM 72.

The temperature/humidity tables 77 for all the colors are created in the same manner. Accordingly, the following description will be directed to one color (which will be referred to as a "target color" hereinafter).

Under one of the plurality of different combinations of temperature and relative humidity, the patch formation operation is executed to form a plurality of patches on the standard papers, while varying the effective developing bias voltage to various different values. The transmission density-determining operation is executed to determine the transmission densities of the patches. The patch formation operation and the transmission density-determining operation are the same as those that are executed during the first embodiment to determine the voltage/transmission density curve of FIG. 6. The above-described operation is repeatedly executed for all the plurality of different combinations of temperature and relative humidity.

FIG. 11 shows the voltage/transmission density curves for three different temperature/humidity combinations among the 36 different temperature/humidity combinations. That is, FIG. 11 shows: a voltage/transmission density curve HH for the high temperature/humidity combination of temperature of 30° C. and the relative humidity of 80%; a voltage/transmission density curve NN for the normal temperature/humidity combination of temperature of 20° C. and the relative humidity of 60%; and a voltage/transmission density curve LL for the low temperature/humidity combination of temperature of 10° C. and the relative humidity of 20%.

A target transmission density Dr is determined within a region on the transmission density axis (vertical axis) in which the transmission density is proportional to the effective developing bias voltage in the voltage/transmission density curves of all the 36 temperature/humidity combinations.

Then, based on the voltage/transmission density curve for each temperature/humidity combination, a target effective developing bias voltage that corresponds to the target transmission density Dr is determined for each temperature/humidity combination. The thus determined target effective developing bias voltage is recorded in the temperature/humidity table 77 in correspondence with the corresponding temperature/humidity combination.

For example, the target effective developing bias voltages VHH, VNN, and VLL are determined for the high temperature/humidity combination, the normal temperature/humidity combination, and the low temperature/humidity combination, respectively, as shown in FIG. 11. The target effective developing bias voltages VHH, VNN, and VLL are listed in the temperature/humidity table 77 in correspondence with the high, normal, and low temperature/humidity combinations, respectively.

After a user purchases the color laser printer 1, the CPU 71 executes a density correction processing of the present embodiment for each color every time before starting image formation operation.

Next will be described the density correction processing of the present embodiment.

It is noted that the density correction processing is the same for all the colors. Accordingly, the density correction processing will be described below for one color (which will be referred to as a "target color" hereinafter)

First, the CPU 71 receives, from the temperature/humidity sensor 76, a detection signal indicative of a combination of the detected temperature and relative humidity. The CPU 71 then refers to the temperature/humidity table 77 for the target color, and reads out one target effective developing bias voltage value that corresponds to one combination of temperature and relative humidity that is equal to the detected temperature and relative humidity.

There will possibly be the case that at least one of the temperature and the humidity detected by the temperature/humidity sensor 76 is different from all the temperature values and all the relative humidity values stored in the temperature/humidity table 77.

In this case, the temperature value that is the closest to the detected temperature is selected among the temperature values in the temperature/humidity table 77, and the relative humidity value that is the closest to the detected relative humidity is selected among the relative humidity values in the temperature/humidity table 77. Then, one target effective developing bias voltage value that corresponds to a combination of the selected temperature and the selected humidity is selected from the temperature/humidity table 77.

For example, now assume that the temperature and the relative humidity detected by the temperature/humidity sensor 76 are 22° C. and 35%, respectively. In this case, the CPU 71 reads out, from the temperature/humidity table 77, one target effective developing bias voltage value that corresponds to a combination of the temperature of 20° C. and the relative humidity of 40%.

Alternatively, the CPU 71 may read out several target effective developing bias voltage values from the temperature/humidity table 77, and perform interpolation calculations based on the read out several target effective developing bias voltage values to determine one target effective developing bias voltage value that suitably corresponds to a combination of the detected temperature and relative humidity.

For example, if the temperature and the relative humidity detected by the temperature/humidity sensor 76 are 22° C. and 35%, respectively, as described above, the CPU 71 may read out four target effective developing bias voltage values that correspond to four combinations of: temperature of 20° C. and relative humidity of 20%; temperature of 20° C. and relative humidity of 40%; temperature of 25° C. and relative humidity of 20%; and temperature of 25° C. and relative humidity of 40%. The target effective developing bias voltage for the temperature of 22° C. and the relative humidity of 35% can be determined by subjecting the readout four target effective developing bias voltage values to interpolation calculations.

The CPU 71 then determines the value of the developing bias voltage to be applied to the developing roller 33 for the target color by adding the determined target effective developing bias voltage to the predetermined electrostatic latent image potential.

The CPU 71 executes the above-described density correction processing for each of all the colors, to determine the developing bias voltage for each color. Thereafter, the CPU 71 controls the DC power source 75 to apply the developing roller 33 for each color with the developing bias voltage of the determined value, and starts executing the image formation operation. This ensures that images of each color will be formed on the papers 3 stably at its corresponding constant target transmission density Dr, regardless of changes in the temperature and relative humidity around the color laser printer 1.

Third Embodiment

Next, a third embodiment will be described with reference to FIG. 12-FIG. 14.

Figure 12:
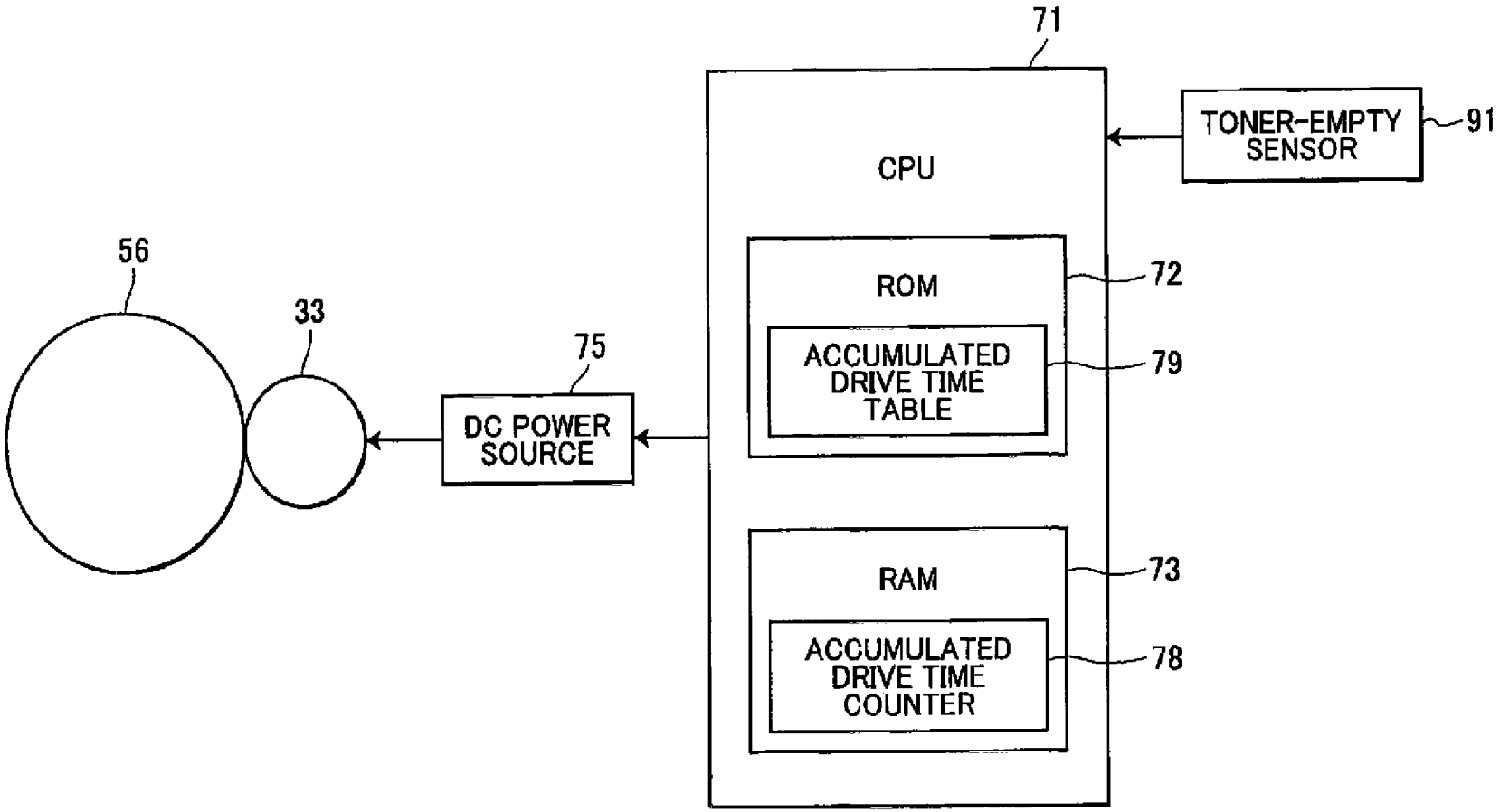
FIG. 12 is a block diagram of a control system for controlling the value of the effective developing bias voltage based on an accumulated drive time table according to a third embodiment.

The control system according to the third embodiment is shown in FIG. 12, and is different from that of the second embodiment (FIG. 9) as described below. In FIG. 12, portions corresponding to components in FIG. 9 are denoted by the same reference numerals as those used in FIG. 9.

According to the present embodiment, the temperature/humidity sensor 76 is not provided in the color laser printer 1. The temperature/humidity tables 77 are not stored in the ROM 72. Instead, the RAM 73 is provided with four accumulated drive time counters 78 in one to one correspondence with all the four colors.

The accumulated drive time counter 78 for each color is for measuring the length of the accumulated drive time, during which the corresponding developing roller 33 has been applied with the developing bias voltage to perform developing operation since toner had been introduced into the corresponding toner accommodating chamber 31 at the latest.

When the toner-empty signal from the toner-empty sensor 91 for one color is canceled, the CPU 71 determines that toner for the subject color has been newly introduced into the corresponding toner accommodating chamber 31, and resets the accumulated drive time counter 78 for the target color. After being reset, the accumulated drive time counter 78 starts counting and accumulating the drive time while the corresponding developing roller 33 is being operated.

According to the present embodiment, the ROM 72 stores therein four accumulated drive time tables 79 in one to one correspondence with all the four colors. The ROM 72 stores the accumulated drive time tables 79 for all the colors beforehand.

Figure 13:
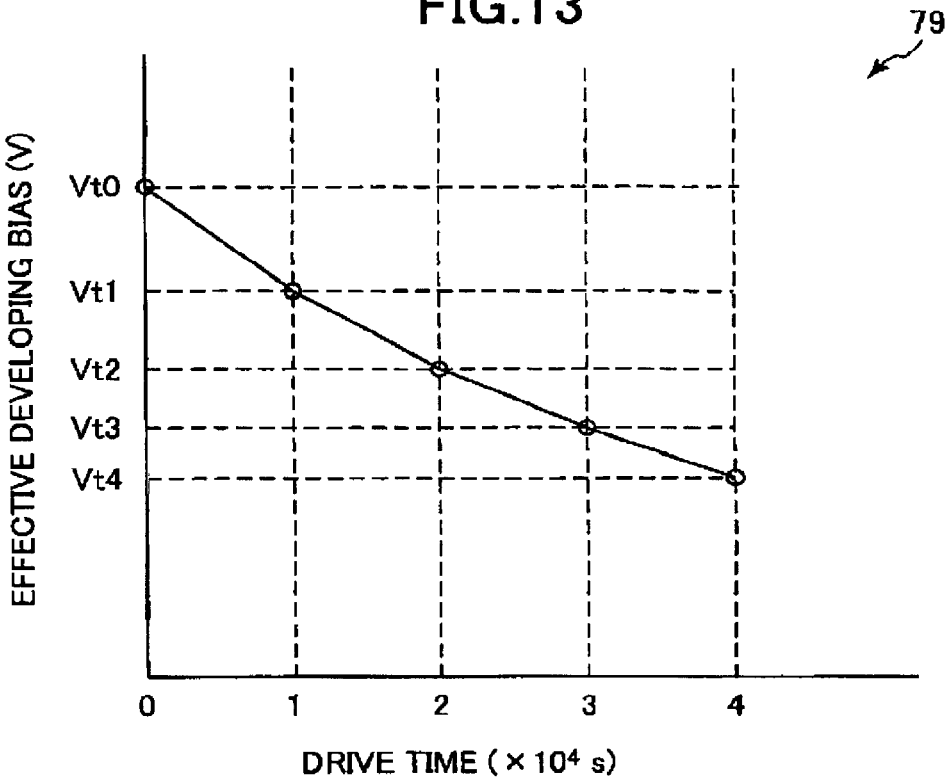
FIG. 13 shows details of the accumulated drive time table of FIG. 12.

As shown in FIG. 13, the accumulated drive time table 79 for each color lists up a plurality of target effective developing bias voltage values in one-to-one correspondence with a plurality of different lengths of the accumulated drive time.

In this example, the accumulated drive time table 79 for each color lists up target effective developing bias voltage values Vt0, Vt1, Vt2, Vt3, and Vt4 in one-to-one correspondence with five different lengths of the accumulated drive time, including: 0 seconds, $1\times10^4$ seconds, $2\times10^4$ seconds, $3\times10^4$ seconds, and $4\times10^4$ seconds.

Next will be described with reference to FIG. 14 how to create the accumulated drive time table 79. Before the color laser printer 1 is shipped from the manufacturer, the accumulated drive time table 79 is created for each color and is stored in the ROM 72.

The accumulated drive time tables 79 for all the colors are created in the same manner. Accordingly, the following description will be directed to one color (which will be referred to as a "target color" hereinafter).

Immediately after the accumulated drive time counter 78 is reset, the patch formation operation is executed to form a plurality of patches on the paper 3, while varying the effective developing bias voltage to various different values. The transmission density-determining operation is executed to determine the transmission density of the patches. The patch formation operation and the transmission density-determining operation are the same as those executed during the first embodiment. The relationship between the transmission density and the effective developing bias voltage is determined as a voltage/transmission density curve for the accumulated drive time of 0 second as shown in FIG. 14.

Subsequently, images of character patterns with a print area ratio of 4% are formed on the sheets of paper repeatedly and continuously. The print area ratio is the proportion of the area of the image formation portion (print portion) with respect to the area of the surface of the paper 3. Every time when the accumulated drive time reaches $1\times10^4$ seconds, $2\times10^4$ seconds, $3\times10^4$ seconds, and $4\times10^4$ seconds, the patch formation operation is executed again to form patches on the paper 3 while varying the effective developing bias voltage to various different values and the transmission density-determining operation is executed to determine the transmission densities of the patches. The patch formation operation and the transmission density-determining operation are the same as those described above. The relationship between the transmission density and the effective developing bias voltage is determined as a voltage/transmission density curve for the accumulated drive time of $1\times10^4$ seconds, $2\times10^4$ seconds, $3\times10^4$ seconds, and $4\times10^4$ seconds, respectively, as shown in FIG. 14.

A target transmission density Dr is determined within a region in which the transmission density is proportional to the effective developing bias voltage in the voltage/transmission density curves for all the five accumulated drive times of 0 seconds, $1\times10^4$ seconds, $2\times10^4$ seconds, $3\times10^4$ seconds, and $4\times10^4$ seconds.

Then, based on the voltage/transmission density curve for each accumulated drive time, a target effective developing bias voltage that corresponds to the target transmission density Dr is determined for the corresponding accumulated drive time. The thus determined target effective developing bias voltage is recorded in the accumulated drive time table 79 in correspondence with the corresponding accumulated drive time length.

Figure 14:
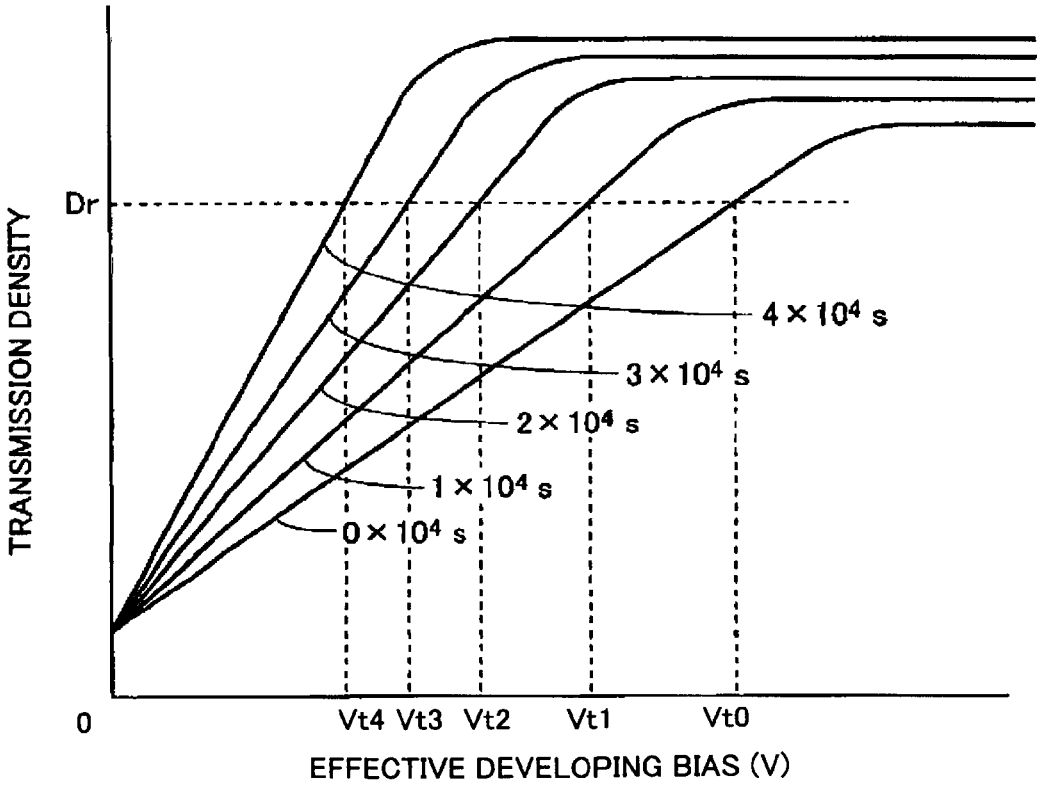
FIG. 14 illustrates a plurality of relationships between the effective developing bias voltage and the transmission density for a plurality of different lengths of the accumulated drive time to indicate how to create the accumulated drive time table of FIG. 12.

In this example, the target effective developing bias voltages Vt0, Vt1, Vt2, Vt3, and Vt4 are determined for the accumulated drive time lengths of 0 seconds, $1\times10^4$ seconds, $2\times10^4$ seconds, $3\times10^4$ seconds, and $4\times10^4$ seconds, respectively, as shown in FIG. 14. The target effective developing bias voltages Vt0, Vt1, Vt2, Vt3, and Vt4 are listed in the accumulated drive time table 79 in correspondence with the accumulated drive time lengths of 0 seconds, $1\times10^4$ seconds, $2\times10^4$ seconds, $3\times10^4$ seconds, and $4\times10^4$ seconds, respectively, as shown in FIG. 13.

After a user purchases the color laser printer 1, every time when toner is newly introduced into the toner accommodating chamber 31, the accumulated drive time counter 78 starts accumulating the length of time during which the developing roller 33 is being operated.

Every time before starting image formation operation, the CPU 71 executes a density correction processing according to the present embodiment for each color.

Next will be described the density correction processing of the present embodiment.

It is noted that the density correction processing is the same for all the colors. Accordingly, the density correction processing will be described below for one color (which will be referred to as a "target color" hereinafter)

First, the CPU 71 checks the accumulated drive time that is presently stored in the accumulated drive time counter 78 for the target color, refers to the accumulated drive time table 79 for the target color, and reads out one target effective developing bias voltage value that corresponds to one accumulated drive time value that is equal to the present accumulated drive time value.

More specifically, assume that the accumulated drive time length that is stored in the accumulated drive time counter 78 when the image formation operation is started to be performed, reaches either one of 0 second, $1\times10^4$ seconds, $2\times10^4$ seconds, $3\times10^4$ seconds, and $4\times10^4$ seconds. In this case, the CPU 71 reads out the corresponding target effective developing bias voltage value Vt0, Vt1, Vt2, Vt3, or Vt4.

There will possibly be the case that the accumulated drive time length that is stored in the accumulated drive time counter 78 when the image formation operation is started, is different from any of the 0 second, $1\times10^4$ seconds, $2\times10^4$ seconds, $3\times10^4$ seconds, and $4\times10^4$ seconds stored in the accumulated drive time 79.

In this case, from among the accumulated drive times of 0 second, $1\times10^4$ seconds, $2\times10^4$ seconds, $3\times10^4$ seconds, and $4\times10^4$ seconds, the CPU 71 may select one accumulated drive time that is the closest to the present accumulated drive time. Then, the CPU 71 reads out one target effective developing bias voltage value that corresponds to the selected accumulated drive time from the accumulated drive time table 79.

Alternatively, from among the accumulated drive times of 0 second, $1\times10^4$ seconds, $2\times10^4$ seconds, $3\times10^4$ seconds, and $4\times10^4$ seconds, the CPU 71 may select two accumulated drive times, which are the first and second closest to the present accumulated drive time and between which the present accumulated drive time falls. The CPU 71 then reads out two target effective developing bias voltage values that correspond to the selected two accumulated drive times from the accumulated drive time table 79. The CPU 71 performs interpolation calculations based on the read out two target effective developing bias voltage values to determine one target effective developing bias voltage value that suitably corresponds to the present accumulated drive time.

The CPU 71 then determines the value of the developing bias voltage to be applied to the developing roller 33 for the target color by adding the predetermined electrostatic latent image potential to the thus-determined target effective developing bias voltage.

The CPU 71 executes the above-described density correction processing for each of all the colors, to determine the developing bias voltage for each of all the colors.

Thereafter, the CPU 71 controls the DC power source 75 to apply the developing roller 33 for each color with the developing bias voltage of the determined value, and starts executing the image formation operation. This ensures that images of each color will be formed on the papers 3 stably at its corresponding constant target transmission density Dr, regardless of how long the developing roller 33 has been operated since toner had been newly introduced in the toner accommodating chamber 31 at the latest.

According to the present embodiment, contrarily to the first embodiment, even though toner has such characteristics that the charge amount of toner will decrease as the toner is repeatedly used for image formation operation, it becomes unnecessary to replenish new toner to the toner accommodating chamber 31.

Fourth Embodiment

Next, a fourth embodiment will be described with reference to FIG. 15(*a*)-FIG. 15(*b*).

Figure 15A:
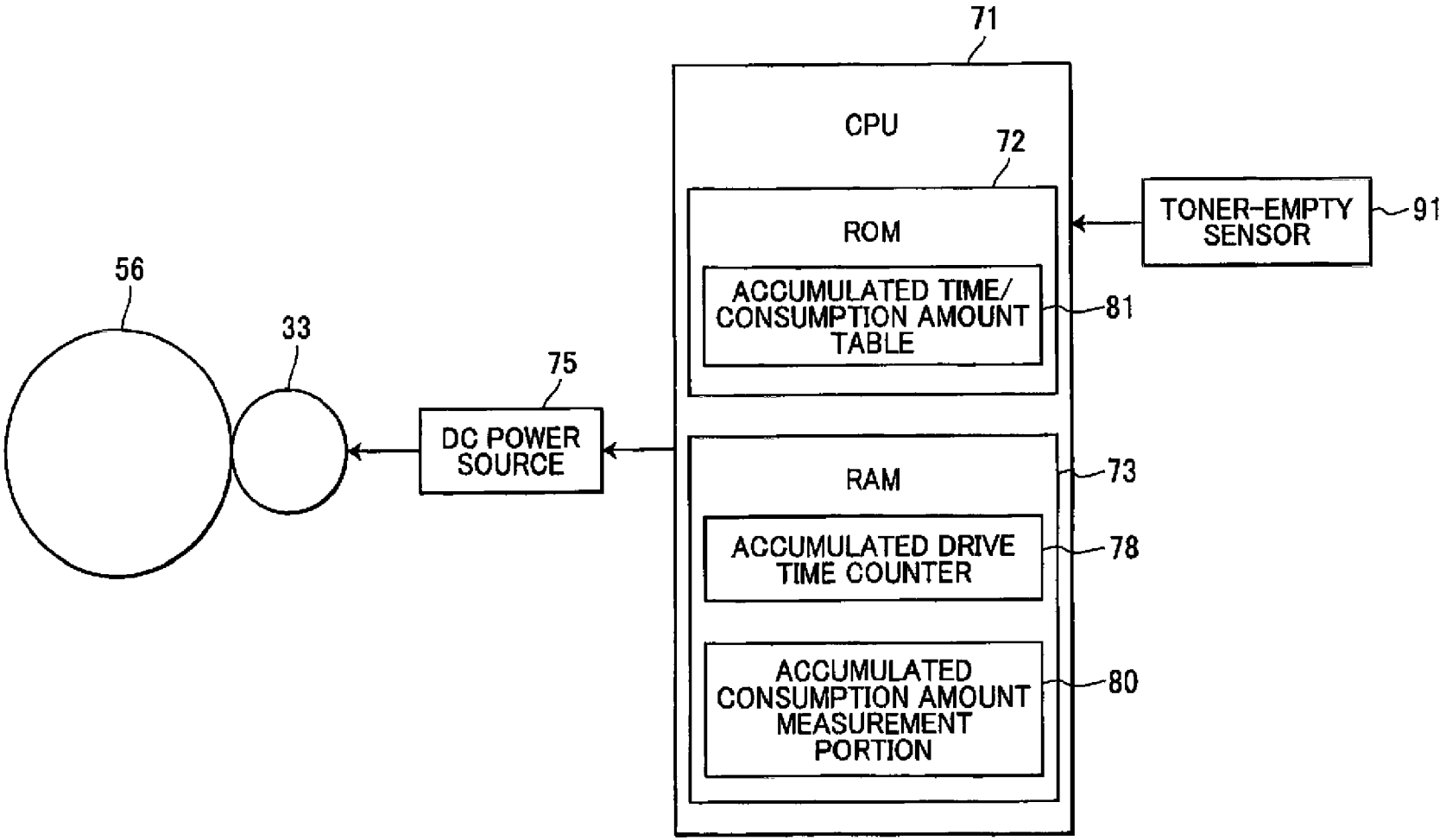
FIG. 15(*a*) is a block diagram of a control system for controlling the value of the effective developing bias voltage based on an accumulated drive time/consumption amount table in a fourth embodiment.

The control system according to the third embodiment is shown in FIG. 15(*a*), and is different from that of the third embodiment (FIG. 12) as described below. In FIG. 15(*a*), portions corresponding to components in FIG. 12 are denoted by the same reference numerals as those used in FIG. 12.

According to the present embodiment, the RAM 73 is further provided with four accumulated consumption amount measurement portions 80 in one to one correspondence with all the four colors. The accumulated consumption amount measurement portion 80 for each color is for measuring and accumulating the amount of the corresponding toner that has been consumed after the toner had been newly introduced into the corresponding toner accumulating chamber 31.

When the toner-empty signal from the toner-empty sensor 91 for one color is canceled, the CPU 71 determines that toner for the subject color has been newly introduced into the corresponding toner accommodating chamber 31, and resets the accumulated drive time counter 78 and the accumulated consumption amount measurement portion 80 for the subject color. After being reset, the accumulated drive time counter 78 starts counting and accumulating the drive time while the corresponding developing roller 33 is being operated, and the accumulated consumption amount measurement portion 80 starts measuring and accumulating the consumption amount of toner while the corresponding developing roller 33 is being operated. The accumulated consumption amount measurement portion 80 stores therein the accumulated consumption amount.

More specifically, the accumulated consumption amount measurement portion 80 for each color calculates the total print area or the total number of dots that has been formed on the paper 3 since toner had been newly introduced into the corresponding toner accumulating chamber 31. The accumulated consumption amount measurement portion 80 performs its calculation based on image data that has been used for executing a high-speed scan by the corresponding scanner unit 19 since toner had been newly introduced into the corresponding toner accumulating chamber 31. Then, based on the calculated total print area, the accumulated consumption amount measurement portion 80 calculates the accumulated consumption amount of toner that has been consumed since toner had been newly introduced into the toner accumulating chamber 31 and that is substantially proportional to the total print area.

According to the present embodiment, the ROM 72 does not store the accumulated drive time tables 79, but stores four accumulated time/consumption amount tables 81 in one to one correspondence with all the four colors. The ROM 72 stores the accumulated time/consumption amount tables 81 for all the colors beforehand.

As shown in FIG. 15(*b*), the accumulated time/consumption amount table 81 for each color lists up a plurality of target effective developing bias voltages in one-to-one correspondence with a plurality of different combinations of the accumulated drive time length and accumulated toner consumption amount.

Next will be described how to create the accumulated time/consumption amount table 81. Before the color laser printer 1 is shipped from the manufacturer, the accumulated time/consumption amount table 81 is created for each color and is stored in the ROM 72.

The accumulated time/consumption amount table 81 for all the colors are created in the same manner. Accordingly, the following description will be directed to one color (which will be referred to as a "target color" hereinafter).

Immediately after the accumulated drive time counter 78 and the accumulated consumption amount measurement portion 80 are reset, the patch formation operation is executed to form a plurality of patches on the paper 3, while varying the effective developing bias voltage to various different values. The transmission density-determining operation is executed to determine the transmission density of the patches. The patch formation operation and the transmission density-determining operation are the same as those executed during the first embodiment. The relationship between the transmission density and the effective developing bias voltage is determined as a voltage/transmission density curve for the accumulated drive time of 0 second as shown in FIG. 14.

Subsequently, images of character patterns with a print area ratio of 1% are formed on the sheets of paper repeatedly and continuously. When the accumulated drive time reaches $1\times10^4$ seconds, the accumulated consumption amount measurement portion 80 calculates the accumulated toner consumption amount based on the total print area that has been printed in total until the accumulated drive time reaches $1\times10^4$ seconds. Also, the patch formation operation is executed to form patches on the paper 3 while varying the effective developing bias voltage to various different values. The transmission density-determining operation is executed to determine the transmission densities of the patches. The patch formation operation and the transmission density-determining operation are the same as those described above. The relationship between the transmission density and the effective developing bias voltage is determined as a voltage/transmission density curve for the combination of the present accumulated drive time ($1\times10^4$ seconds) and the present accumulated toner consumption amount.

Images of character patterns with a print area ratio of 1% are formed on the sheets of paper further repeatedly and continuously. Every time when the accumulated drive time reaches $2\times10^4$ seconds, $3\times10^4$ seconds, and $4\times10^4$ seconds, the operations the same as those that have been executed when the accumulated drive time reaches $1\times10^4$ seconds are executed to determine a voltage/transmission density curve for the combination of the corresponding accumulated drive time ($2\times10^4$ seconds, $3\times10^4$ seconds, or $4\times10^4$ seconds) and the corresponding accumulated toner consumption amount. Thus, a plurality of voltage/transmission density curves are determined for the combination of the accumulated drive times and the accumulated toner consumption amounts.

The above-described operations are executed while continuously printing images of character patterns with a print area ratio of 1% from 0 second to $4\times10^4$ seconds. The operations the same as the above-described operations are executed while continuously printing images of character patterns with a print area ratio of 3% from 0 second to $4\times10^4$ seconds. Similarly, the operations the same as the above-described operations axe further executed while continuously printing images of character patterns with a print area ratio of one of 4%, 6%, and 8% from 0 second to $4\times10^4$ seconds. In this way, a plurality of voltage/transmission density curves are determined in correspondence with a plurality of different combinations of the accumulated drive time lengths and the accumulated toner consumption amounts.

A target transmission density Dr is determined within a region on the transmission density axis (vertical axis) in which the transmission density is proportional to the effective developing bias voltage in all the plurality of voltage/transmission density curves.

Then, based on the voltage/transmission density curve for each combination of the accumulated drive time and the accumulated consumption amount, a target effective developing bias voltage that corresponds to the target transmission density Dr is determined for the corresponding combination of the accumulated drive time and the accumulated consumption amount. The thus determined target effective developing bias voltage is recorded in the time/consumption amount table 81 in correspondence with the corresponding combination of the accumulated drive time and the accumulated consumption amount.

After a user purchases the color laser printer 1, every time when toner is newly introduced into the toner accommodating chamber 31 for one color, the corresponding accumulated drive time counter 78 starts accumulating the length of time during which the corresponding developing roller 33 is being operated, and the accumulated consumption amount measuring portion 80 starts accumulating the amount of the corresponding toner that is consumed.

Every time before starting image formation operation, the CPU 71 executes a density correction processing according to the present embodiment for each color.

Next will be described the density correction processing of the present embodiment.

It is noted that the density correction processing is the same for all the colors. Accordingly, the density correction processing will be described below for one color (which will be referred to as a "target color" hereinafter).

First, the CPU 71 checks the accumulated drive time that is presently stored in the accumulated drive time counter 78 for the target color and the accumulated consumption amount that is presently stored in the accumulated consumption amount measuring portion 80 for the target color, refers to the accumulated time/consumption table 81 for the target color, and reads out one target effective developing bias voltage value that corresponds to one combination of accumulated drive time and the accumulated consumption amount that is equal to the present accumulated drive time and the present accumulated consumption amount.

There will possibly be the case that at least one of the accumulated drive time length presently stored in the accumulated drive time counter 78 and the accumulated consumption amount presently stored in the accumulated consumption amount measuring portion 80 is different from all the accumulated drive time lengths and all the accumulated consumption amount values stored in the accumulated time/consumption amount table 81.

In this case, the accumulated drive time length that is the closest to the present accumulated drive time length is selected among the accumulated drive time lengths in the accumulated time/consumption amount table 81, and the accumulated consumption amount value that is the closest to the present accumulated consumption amount is selected among the accumulated consumption amount values in the accumulated time/consumption amount table 81. Then, one target effective developing bias voltage value that corresponds to a combination of the selected accumulated drive time length and the selected accumulated consumption amount is selected from the accumulated time/consumption amount table 81.

Alternatively, the CPU 71 may read out several target effective developing bias voltage values from the accumulated time/consumption amount table 81, and perform interpolation calculations based on the read out several target effective developing bias voltage values to determine one target effective developing bias voltage value that suitably corresponds to a combination of the present accumulated drive time length and the present accumulated consumption amount.

The CPU 71 then determines the value of the developing bias voltage to be applied to the developing roller 33 for the target color by adding the predetermined electrostatic latent image potential to the thus-determined target effective developing bias voltage.

The CPU 71 executes the above-described density correction processing for each of all the colors, to determine the developing bias voltage for each of all the colors. Thereafter, the CPU 71 controls the DC power source 75 to apply the developing roller 33 for each color with the developing bias voltage of the determined value, and starts executing the image formation operation. This ensures that images of each color will be formed on the papers 3 stably at its corresponding constant target transmission density Dr, regardless of how long the developing roller 33 has been operated and how much toner has been consumed since toner had been newly introduced in the toner accommodating chamber 31 latest.

While the invention has been described in detail with reference to the specific embodiments thereof, it would be apparent to those skilled in the art that various changes and modifications may be made therein without departing from the spirit of the invention.

For example, in the above-described embodiments, the developing bias voltage applied to the developing roller 33 is controlled, in order to control the effective developing bias voltage. However, the effective developing bias voltage can be controlled in other manners. For example, the Scorotron charger 57 may be controlled to adjust the potential on the surface of the photosensitive drum 56. Or, the laser emitting portion may be controlled to adjust the intensity of the laser beam irradiated on the photosensitive drum 56, thereby adjusting the potential at the laser-beam irradiated portions on the photosensitive drum 56.

In the second embodiment, instead of the temperature/humidity sensor 76, a temperature sensor may be mounted in the color laser printer 1. In this case, each temperature/humidity table 77 (FIG. 10) is modified to include only one column for a reference relative humidity (60%, for example). The column for the reference relative humidity lists up a plurality of target effective developing bias voltages in one to one correspondence with a plurality of different values of temperature. In this example, the column for the reference relative humidity lists up six target effective developing bias voltages in one to one correspondence with the six values of temperature of 10° C., 15° C., 20° C., 25° C., 30° C., and 35° C. During the density correction processing, the CPU 71 receives, from the temperature sensor, a detection signal indicative of the detected temperature. The CPU 71 selects, from the modified temperature/humidity table 77, one target effective developing bias voltage value that corresponds to the detected temperature. Or, the CPU 71 may select, from the modified temperature/humidity table 77, several target effective developing bias voltage values that correspond to the detected temperature, and perform interpolation calculation based on the selected target effective developing bias voltage values. The temperature sensor can be produced at a lower cost than the temperature/humidity sensor 76. A small amount of memory area is sufficient to hold only one column of the temperature/humidity table 77.

Similarly, in the second embodiment, instead of the temperature/humidity sensor 76, a humidity sensor may be mounted in the color laser printer 1. In this case, each temperature/humidity table 77 (FIG. 10) is modified to include only one row for a reference temperature (20° C., for example). The row for the reference temperature lists up a plurality of target effective developing bias voltages in one to one correspondence with a plurality of different values of relative humidity. In this example, the row for the reference temperature lists up six target effective developing bias voltages in one to one correspondence with the six values of relative humidity of 0%, 20%, 40%, 60%, 80%, and 100%. During the density correction processing, the CPU 71 receives, from the humidity sensor, a detection signal indicative of the detected relative humidity. The CPU 71 selects, from the modified temperature/humidity table 77, one target effective developing bias voltage value that corresponds to the detected relative humidity. Or, the CPU 71 may select, from the modified temperature/humidity table 77, several target effective developing bias voltage values that correspond to the detected relative humidity, and perform interpolation calculation based on the selected target effective developing bias voltage values. The humidity sensor can be produced at a lower cost than the temperature/humidity sensor 76. A small amount of memory area is sufficient to hold only one row of the temperature/humidity table 77.

What is claimed is:

1. An image-forming device, comprising:

an image bearing body that forms a latent image thereon;

a developer bearing body that is disposed facing the image bearing body and that is in contact with the image bearing body, the developer bearing body supporting thereon a non-magnetic, single-component developer agent; and a controller that controls the value of an effective developer bias that is established between the electric potential of the latent image and the electric potential of the developer bearing body, to thereby develop the latent image with the non-magnetic, single-component developer agent, the controller setting a target transmission density in a region in which the transmission density of the developer agent is in a proportional relationship with respect to the effective developer bias, and controlling the value of the effective developer bias based on the target transmission density and the proportional relationship between the transmission density and the effective developer bias.

2. The image-forming device as claimed in claim 1, further comprising a density detector that detects the transmission density of the developing agent, wherein the controller controls the value of the effective developer bias based on a value detected by the density detector.

3. The image-forming device as claimed in claim 1, further comprising a temperature/humidity detector that detects temperature and humidity, wherein the controller includes a memory that stores therein a temperature/humidity table that records therein a plurality of values for the effective developer bias in correspondence with a plurality of different combinations of temperature and humidity, the controller controlling the value of the effective developer bias based on the temperature/humidity table.

4. The image-forming device as claimed in claim 1, further comprising a drive time measuring device that measures the accumulated length of the drive time, during which the developer bearing body has been applied with the effective developer bias since the developer agent had been introduced latest to the developer bearing body, wherein the controller includes a memory that stores therein a time table that records therein a plurality of values for the effective developer bias in correspondence with a plurality of different accumulated drive time lengths, the controller controlling the value of the effective developer bias based on the time table.

5. The image-forming device as claimed in claim 1, further comprising:

a drive time measuring device that measures the length of the accumulated drive time during which the developer bearing body has been operated to develop the latent image since the developer agent had been introduced latest to the developer bearing body; and a consumption amount measuring device that measures the accumulated consumption amount of developer agent that has been consumed since the developer agent had been introduced latest to the developer bearing body, wherein the controller includes a memory that stores therein a time/consumption amount table that records therein a plurality of values for the effective developer bias in correspondence with a plurality of different combinations of the accumulated drive time lengths and the accumulated consumption amounts, the controller controlling the value of the effective developer bias based on the time/consumption amount table.

6. The image-forming device as claimed in claim 1, wherein the quantity of charge per unit mass of the developer agent that is supported on the surface of the developer bearing body immediately after the entire part of a predetermined region of the image bearing body has been developed is equal to the quantity of charge per unit mass of the developer agent that is supported on the surface of the developer bearing body immediately after no part of the predetermined region of the image bearing body has been developed.

7. The image-forming device as claimed in claim 1, wherein the mass per unit area of the developer agent supported on the surface of the developer bearing body immediately after the entire part of a predetermined region of the image bearing body has been developed is less than the mass per unit area of the developer agent supported on the surface of the developer bearing body immediately after no part of the predetermined region of the image bearing body has been developed.

8. The image-forming device as claimed in claim 1, wherein the controller sets the target transmission density in a region in which the reflection density of the developer agent is saturated with respect to the transmission density.

9. The image-forming device as claimed in claim 1, wherein the controller controls the value of the effective developer bias by controlling the value of an application voltage applied to the developer bearing body.

10. The image-forming device as claimed in claim 1, wherein the developer bearing body moves at a speed of movement that is higher than or equal to 1.5 times the speed of movement, at which the image bearing body moves.

11. The image-forming device as claimed in claim 1, wherein the amount of charge of the developer agent is higher than or equal to 10 μC/g.

12. The image-forming device as claimed in claim 1, wherein the developer agent is a positively charged toner, which includes a styrene-acrylic resin and which is added with a charge regulating resin that imparts a positively charging nature thereto.

13. The image-forming device as claimed in claim 1, wherein:

the image bearing body includes a plurality of image-bearing bodies in one-to-one correspondence with a plurality of different colors, each forming a corresonding latent image thereon;

the developer bearing body includes a plurality of developer bearing bodies in one-to-one correspondence with the plurality of different colors, each developer bearing body being disposed facing the corresponding image bearing body and being in contact with the corresponding image bearing body, each developer bearing body supporting thereon a non-magnetic, single-component developer agent of the corresponding color; and the controller controls the value of the effective developer bias for the plurality of colors independently from one another, the value of the effective developer bias for each color being established between the electric potential of the latent image on the corresponding image bearing body and the electric potential of the corresponding developer bearing body to develop the latent image of the subject color.

14. The image-forming device as claimed in claim 1, further comprising a temperature detector that detects temperature, wherein the controller includes a memory that stores therein a temperature table that records therein a plurality of values for the effective developer bias in correspondence with a plurality of different values of temperature, the controller controlling the value of the effective developer bias based on the temperature table.

15. The image-forming device as claimed in claim 1, further comprising a humidity detector that detects humidity, wherein the controller includes a memory that stores therein a humidity table that records therein a plurality of values for the effective developer bias in correspondence with a plurality of different values of humidity, the controller controlling the value of the effective developer bias based on the humidity table.

* * * * *